US007374265B2

(12) United States Patent
Yamane et al.

(10) Patent No.: US 7,374,265 B2
(45) Date of Patent: May 20, 2008

(54) INK JET PRINTING APPARATUS AND INK JET PRINTING METHOD

(75) Inventors: Toru Yamane, Kanagawa (JP); Yasuyuki Tamura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 246 days.

(21) Appl. No.: 10/998,600

(22) Filed: Nov. 30, 2004

(65) Prior Publication Data

US 2005/0122354 A1 Jun. 9, 2005

(30) Foreign Application Priority Data

Dec. 5, 2003 (JP) ..... 2003-408219

(51) Int. Cl.
*B41J 29/38* (2006.01)

(52) U.S. Cl. ..... 347/13; 347/12; 347/42

(58) Field of Classification Search ..... 347/12, 347/13, 19, 41, 42, 5, 9
See application file for complete search history.

(56) References Cited

U.S. PATENT DOCUMENTS 5,477,243 A 12/1995 Tamura
6,310,640 B1 * 10/2001 Askeland ..... 347/41
6,386,668 B1 * 5/2002 Shimizu et al. ..... 347/13
6,520,613 B1 2/2003 Tamura
6,802,583 B2 10/2004 Tamura

FOREIGN PATENT DOCUMENTS

| | | |
|---|---|---|
| EP | 1 080 919 | 3/2001 |
| JP | 8-25693 | 1/1996 |
| JP | 10-278246 | 10/1998 |
| JP | 2000-190484 | * 7/2000 |
| JP | 2002-96455 | 4/2002 |

* cited by examiner

*Primary Examiner*—Lam Son Nguyen
(74) *Attorney, Agent, or Firm*—Fitzpatrick, Cella, Harper & Scinto

(57) ABSTRACT

An ink jet printing apparatus and an ink jet printing method are provided which, when printing small ink droplets at high resolution, can make white lines caused by an "end dot deflection" less visually conspicuous. To that end, an ink jet print head used has a plurality of nozzle substrates arranged that an overlapping region in which the printable areas of respective nozzle substrates partly overlap is formed. According to a print density to be achieved, each of the nozzles corresponding to the overlapping region is controlled for ejection/non-ejection of ink. With this method, it is possible to print as many dots as most match the intensity of the "end dot deflection" phenomenon that varies according to the print density. This enables a blank line to be filled with an appropriate number of dots at all times, regardless of the width of the blank line.

9 Claims, 23 Drawing Sheets

INK JET PRINTING APPARATUS AND INK JET PRINTING METHOD

BACKGROUND OF THE INVENTION

1. Field of the Invention

The present invention relates to an ink jet printing apparatus that forms an image on a print medium using an ink jet print head having arrays of print elements or ink ejection nozzles. The invention also relates to a printing method for the ink jet printing apparatus.

2. Description of the Related Art

As technologies associated with copying machines, information processing devices such as word processors and computers, and communication devices advance, an ink jet printing apparatus that forms digital images on a print medium from information input from these devices by using an ink jet print head are becoming increasingly widespread. To increase a printing speed the ink jet printing apparatus employs nozzle columns made up of many arrayed print elements, each having an ink ejection opening and an ink path. Further, to enable color image printing, it is general practice to use a print head formed with multiple nozzle columns.

The ink jet printing apparatus can be grouped largely into two types: serial type and line type. The serial type printing apparatus uses a print head having a plurality of print elements arrayed in a direction of a print medium feed. An image is progressively formed by repetitively alternating a main scan operation, in which a print head is moved in a direction crossing the print medium feeding direction as it prints, and a sub-scan operation, in which the print medium is fed a predetermined distance equal to a width of a strip of area printed by the main scan. The serial type ink jet printing apparatus is characterized by its relatively small size and low cost.

The line type printing apparatus uses an elongate print head (line type elongate print head) having print elements or nozzles arrayed in line longer than a width of an image to be formed. A print medium is moved relative to the print head only once in a direction crossing the nozzle array direction to form an image. Therefore, compared with the serial type printing apparatus that performs the printing scan operation many times, the line type printing apparatus can form an image much faster. There are increasing demands on the ink jet printing apparatus for higher image quality and faster printing speed and, to meet these requirements, efforts are being made to develop a technology for integrally fabricating nozzles in the print head at high density. Under these circumstances expectations are growing for a printing apparatus equipped with such a line type elongate print head.

In recent years, demands are growing for further improving the printing speed and resolution by making an ink volume of each dot smaller. To meet these demands, one type of ink jet printing system currently in wide use generates thermal energy in each nozzle to cause film boiling in ink to form and expand a bubble and thereby eject an ink droplet. This system has many advantages, including a relative ease with which to reduce the volume of each ink ejection and integrally form nozzles in arrays at high density and an excellent response to the print signal.

Reference 1: Japanese Patent Application Laid-open No. 8-025693 (1996)

Reference 2: Japanese Patent Application Laid-open No. 2002-096455

The printing apparatus using small-volume ink dots, however, may encounter new problems, such as variations in dot landing positions and unstable ejections. For example, when an image is formed by using a print head that has many nozzles arrayed at high density, each ejecting small droplets of 10 pl or less, a phenomenon is observed in which ink droplets ejected from those nozzles at ends of the print head deviate greatly inwardly from their intended landing positions. This phenomenon is referred to as an "end dot deflection."

FIG. 1 illustrates the "end dot deflection" phenomenon. Here are shown dots formed on a print medium by print elements or nozzles located at the ends of a print head that has one column of nozzles. For simplicity only those dots formed by the end nozzles are shown in the form of solid black circles. In reality, however, all nozzles perform a 100% printing. In this example, a serial type printing apparatus is applied and a line shown as "paper feed boundary" in the figure represents a boundary between two printing scans. An upper row of dots shown above this line represents a row of dots printed by the lowermost nozzle in a first printing scan and a lower row of dots below this line represents a row of dots printed by the uppermost nozzle in a second printing scan. The print head forms dots on a print medium by ejecting ink onto the print medium at a predetermined drive frequency as it moves from left to right in the figure.

As can be seen from the figure, dots printed by the end nozzles, i.e., those dots printed by the uppermost end nozzle and the lowermost end nozzle in two scans, are shown to have landed at proper positions close together at the beginning of the printing scan. However, as the scan proceeds, the upper dot row and the lower dot row gradually part from each other, forming a blank or white line on the image.

FIG. 2 schematically shows trajectories of ink droplets ejected from the print head during the scan. In FIG. 2, as it moves in a direction perpendicular to a plane of the drawing, the print head ejects ink droplets from its nozzles toward the print medium as indicated by arrows. As shown in the figure, the ink droplets ejected from the end nozzles of the print head deflect toward the central part of the head. This tendency has been observed to become conspicuous when an image is formed using very small ink droplets and when a printing density is high. However, if a print head with a high nozzle density and small ink droplets is used, this phenomenon does not occur as long as the printing density is not high enough.

While the above explanation concerns a case of the serial type printing apparatus, the "end dot deflection" phenomenon of course occurs with the line type print head, too. In the line type print head, it is common that a plurality of nozzle substrates each having a plurality of nozzles arrayed at high density are arranged in a direction of print width, as shown in FIG. 6. Thus, the "and dot deflection" occurs with the nozzles situated at the ends of each nozzle substrate, with a blank line formed at a position between the nozzle substrates. It is noted that the method of arranging a plurality of these nozzle substrates as described above and the phenomenon of blank line produced between the nozzle substrates are not peculiar to the line type printing apparatus. Also in the serial type, this arrangement is adopted when an elongate print head is used and therefore the blank line phenomenon results.

FIG. 3 and FIG. 4 schematically show printed dots in an area on a print medium between two nozzle substrates, formed by an elongate print head of the line type or serial type printing apparatus. FIG. 3 represents a case in which the print density of the print head is low (25%) and FIG. 4 a case in which the print density is high (100%).

In FIG. 3, H1100A and H1100B represent nozzle substrates arranged close together. In each of the nozzle substrates, nozzle openings H1105 for ejecting ink are arranged at a pitch of Pn. Of these nozzle openings, the shaded ones are nozzle openings that are activated and represent the print density of 25%. 301 represents a state of dots printed by the shaded nozzle openings while moving the print medium in a vertical direction of the drawing. Right-inclined shade lines and left-inclined shade lines indicate from which nozzle substrates the dots of interest have been ejected. In 301, the printed dots are arranged uniformly at the same pitch as the nozzle pitch Pn.

As in FIG. 3, dots printed at a print density of 100% are shown in FIG. 4. In the printed dot array indicated by 401, a gap is produced between a dot group of right-inclined shade lines and a dot group of left-inclined shade lines. That is, ink droplets ejected from the nozzles at the right end of the nozzle substrate H1100A deflect toward left as they land on the print medium and ink droplets ejected from the nozzles at the left end of the nozzle substrate H1100B deflect toward right.

As described above, in ink jet printing apparatus of recent years that eject small ink droplets at a high resolution, the "end dot deflection" poses a serious problem.

Some countermeasures, though not limited to the "end dot deflection," have already been proposed to improve image impairments that occur at a boundary between nozzle substrates. For example, Japanese Patent Application Laid-open No. 8-025693 (1996) discloses a method which overlaps an image printed by the print head in one printing scan and an image printed in the next scan by a predetermined amount. According to this method, of the image data printed in the preceding scan, image data in an area that is to be overlapped in the next scan is masked with a random mask pattern. Further, of the image data that is to be printed in the next scan, image data in an area that overlaps the previous scan is masked with an inverted pattern of the previously applied random mask pattern. With this arrangement, the image impairment characteristic of the boundary between the succeeding printing scans is dispersed in an area of a predetermined width, making a boundary line on the image less conspicuous.

This method can be applied also to the line type print head. That is, the ends of the two nozzle substrates are overlapped, with the nozzles in the overlapped portion printing image data masked with the random mask pattern.

However, since the method of Japanese Patent Application Laid-open No 8-025693 (1996) is not intended specifically for the "end dot deflection," this method may give rise to another problem where the "end dot deflection" phenomenon does not exist. For example, as described in connection with FIG. 3 and FIG. 4, the "end dot deflection" varies in its intensity depending on the print density of the print head. The method of Japanese Patent Application Laid-open No. 8-025693 (1996), however, performs the above-described processing on the boundary portion irrespective of the print density. That is, the boundary portion is always subjected to the processing different than that applied to other areas. Where the "end dot deflection" does not occur, this method may make the boundary portion more distinguished in the form of different texture or dark line. Further, since in the serial type printing apparatus, the greater the overlapping area the lower the printing speed, a problem arises that even a simple image that can be formed with a low print density takes unduly long to print.

There are some printing methods proposed specifically for solving the "end dot deflection" problem. For example, Japanese Patent Application Laid-open No. 2002-096455 discloses a method which, when performing a multipass printing in a serial printing apparatus, involves dividing a nozzle column into a plurality of sub-columns at a predetermined pitch and setting different thinning factors for the different divided sub-columns. With this method, the print density of the nozzles situated at the ends of an area printed in one scan can be set small beforehand. Since the number of dots whose landing positions are deviated from intended positions can be minimized, a blank line such as described in connection with FIG. 1 is rendered indistinguishable.

It is noted, however, that since the method of Japanese Patent Application Laid-open No. 2002-096455 uses a multipass printing as a precondition, it can only be applied to the serial type printing apparatus. Further, since this printing method is intended to print a high-quality image such as photograph using a multipass printing and taking a prolonged time, it cannot be applied to an ink jet printing apparatus that performs a fast printing for industrial applications that this invention is intended to achieve. Further, the method of Japanese Patent Application Laid-open No. 2002-096455 produces differences in the number of ejections or ejection frequency among a plurality of nozzles arrayed in the print head. Those nozzles whose ejection frequencies are high deteriorate in ejection characteristic faster than other nozzles. A print head is determined as not usable when even a single nozzle fails. Thus, the method described in the cited reference, which causes a local portion of the nozzles to print at high frequency, results in a shorter life of the print head.

As described above, in ink jet printing apparatus that perform a high-resolution printing using small droplets, particularly those ink jet printing apparatus that form an image at high speed without performing a multipass printing, the image impairments caused by the "end dot deflection" is not yet resolved.

SUMMARY OF THE INVENTION

The present invention has been accomplished to solve the above problems and to provide an ink jet printing apparatus and an ink jet printing method which, when an image is printed at a high resolution using small ink droplets, can make blank lines caused by the "end dot deflection" less visually conspicuous.

In a first aspect of the present invention, there is provided an ink jet printing apparatus for printing an image on a print medium by ejecting inks from nozzles of an ink jet print head with relative moving between the print medium and the ink jet print head, the ink jet print head having a plurality of nozzle substrates each having a plurality of nozzles arrayed therein, the plurality of nozzles making up a printable area, the nozzle substrates being arranged so that the respective printable areas of adjacent nozzle substrates partly overlap, the apparatus comprising control means for controlling an ejection/non-ejection of ink for each of the nozzles that correspond to an overlapping region in which the respective printable areas of adjacent nozzle substrates partly overlap, according to information related to an ink volume that the nozzle substrates apply to a predetermined area.

In a second aspect of the present invention, there is provided an ink jet printing method for printing an image on a print medium moved relative to an ink jet print head, wherein the ink jet print head having a plurality of nozzle substrates each having a plurality of nozzles arrayed therein to eject ink, the plurality of nozzles making up a printable area, the nozzle substrates being arranged so that the respective printable areas of adjacent nozzle substrates partly overlap, the ink jet printing method comprising:

a control step of controlling an ejection/non-ejection of ink for each of the nozzles that correspond to an overlapping region in which the respective printable areas of adjacent nozzle substrates partly overlap, according to information related to an ink volume that the nozzle substrates apply to a predetermined area.

The above and other objects, effects, features and advantages of the present invention will become more apparent from the following description of embodiments thereof taken in conjunction with the accompanying drawings.

DETAILED DESCRIPTION OF PREFERRED EMBODIMENTS

First Embodiment

Now, a first embodiment of this invention will be described in detail.

Figure 1:
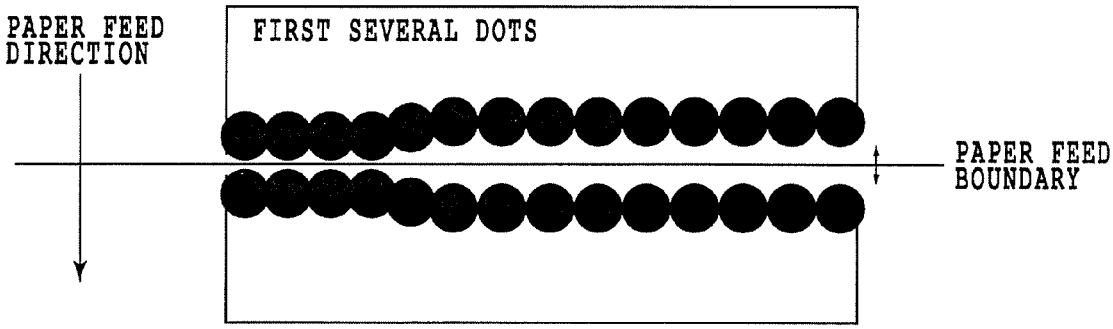
FIG. 1 is a schematic diagram showing an "end dot deflection" phenomenon.
Figure 2:
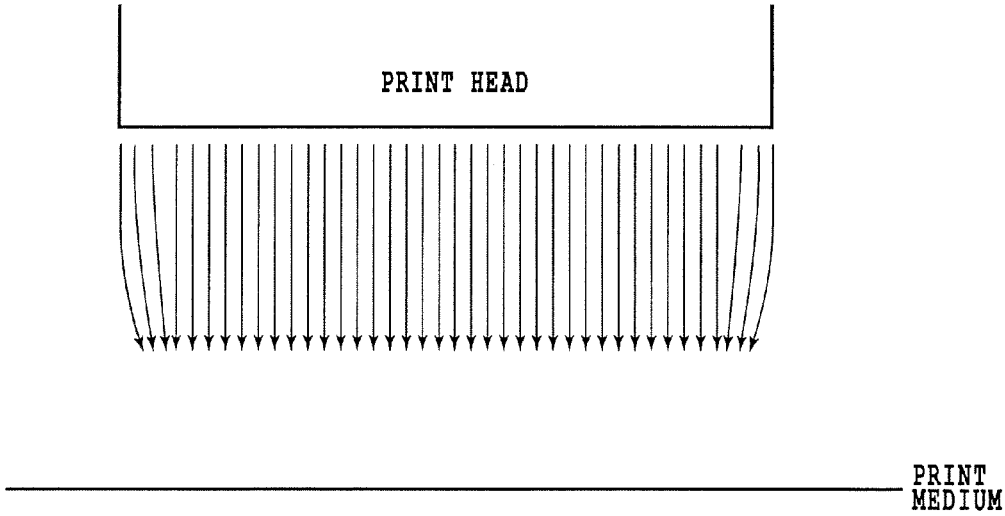
FIG. 2 is a schematic diagram showing trajectories of ink droplets from a print head.
Figure 3:
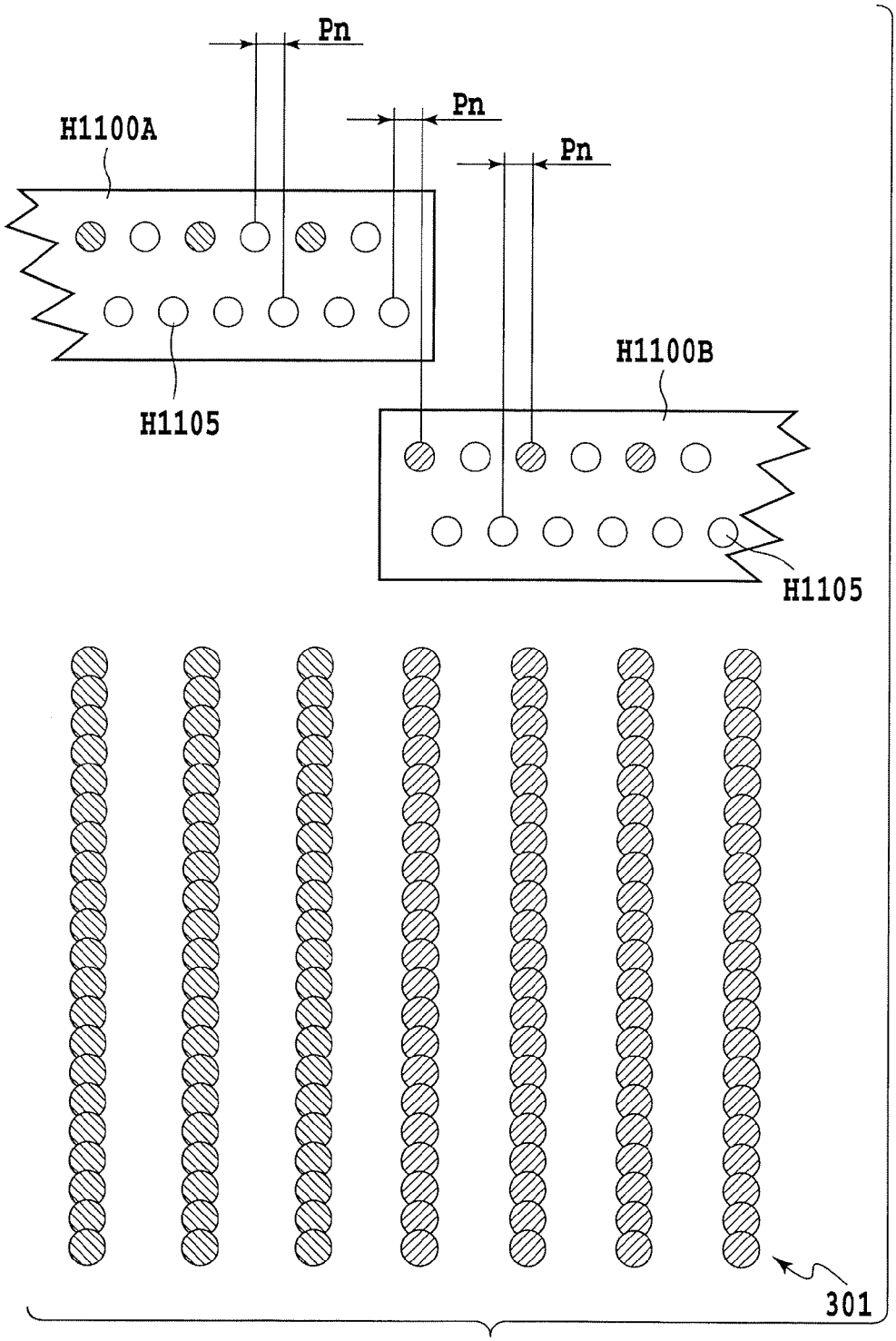
FIG. 3 is a schematic diagram showing dots formed in a boundary area of a print medium between two nozzle substrates of an elongate print head.
Figure 4:
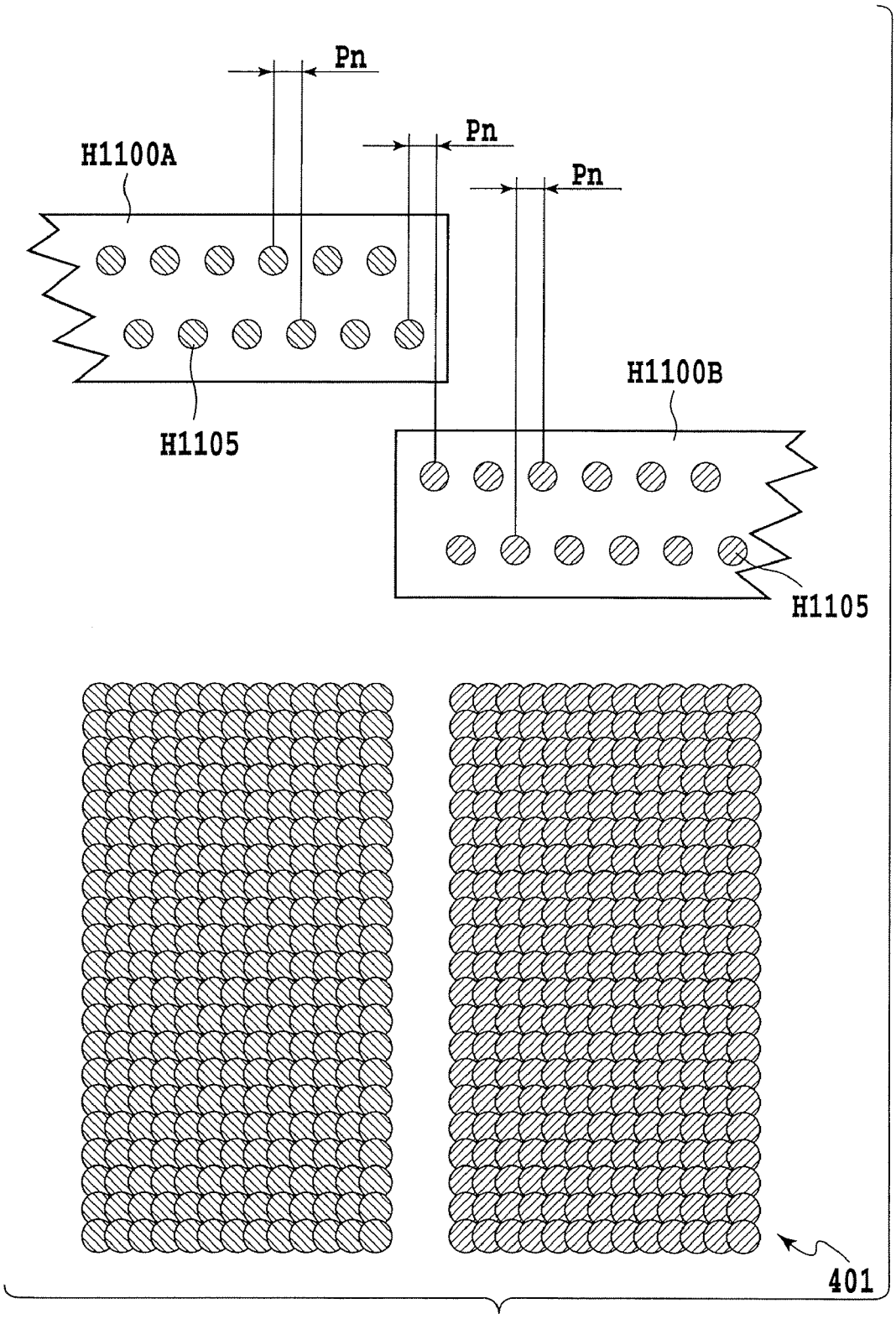
FIG. 4 is a schematic diagram showing dots formed in the boundary area of the print medium between two nozzle substrates of another elongate print head.
Figure 5:
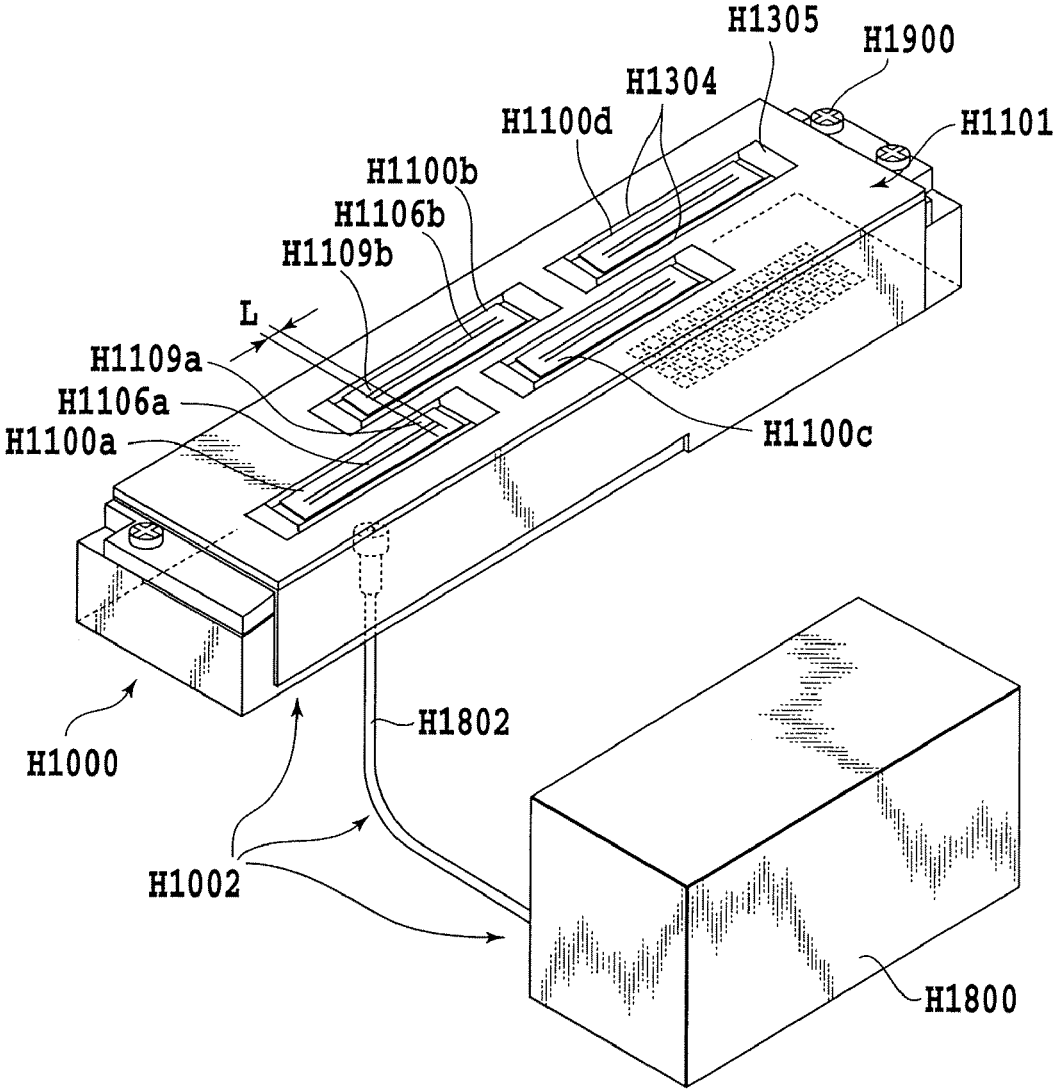
FIG. 5 is a perspective view showing a construction of an ink jet print head applicable to embodiments of this invention.

FIG. 5 is a perspective view showing a construction of an ink jet print head applicable to this embodiment. In FIG. 5, a print head H1000 comprises mainly a nozzle unit H1001 having a functional structure related to ink ejection and an ink supply unit H1002 for supplying ink to the nozzle unit H1001.

Figure 6:
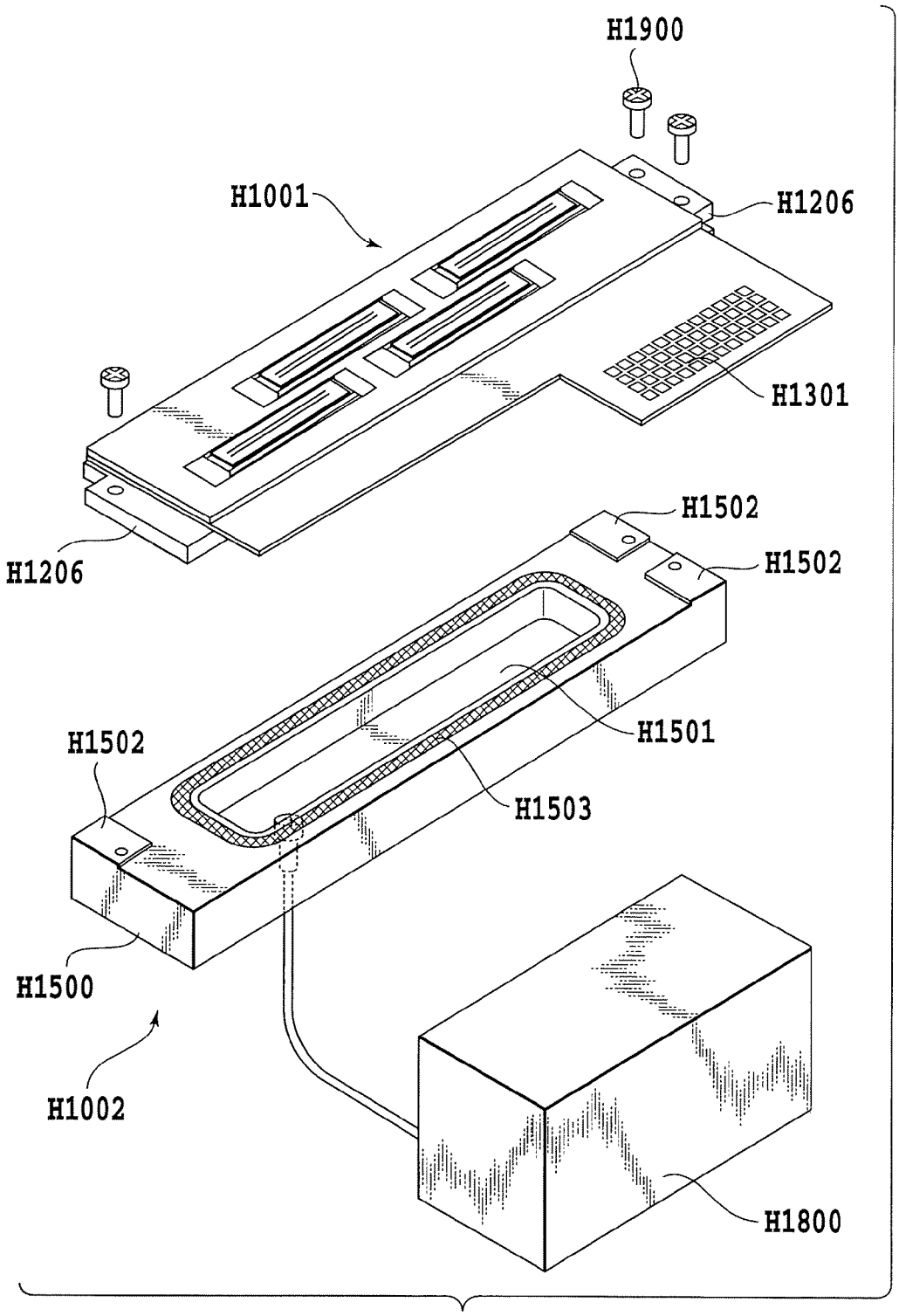
FIG. 6 is an exploded perspective view showing the print head applicable to the embodiments of this invention, disassembled into a nozzle unit and an ink supply unit.

FIG. 6 is an exploded perspective view of the print head H1000 disassembled into the nozzle unit H1001 and the ink supply unit H1002. In the figure, an opening of an ink supply member H1500 and the nozzle unit M1001 are sealed with a third sealant H1503 to hermetically close a common ink chamber H1501. A Z reference plane H1502 of the ink supply member H1500 and a Z-direction reference H1206 of the nozzle unit H1001 are positioned and fixed together by screws 1900. The third sealant H1503 preferably has an ink resistance, hardens at a normal temperature and is flexible enough to withstand a linear expansion difference between different materials. An external signal input terminal H1301 of the nozzle unit H1001 is positioned and secured to a back of the ink supply member H1500.

Figure 7:
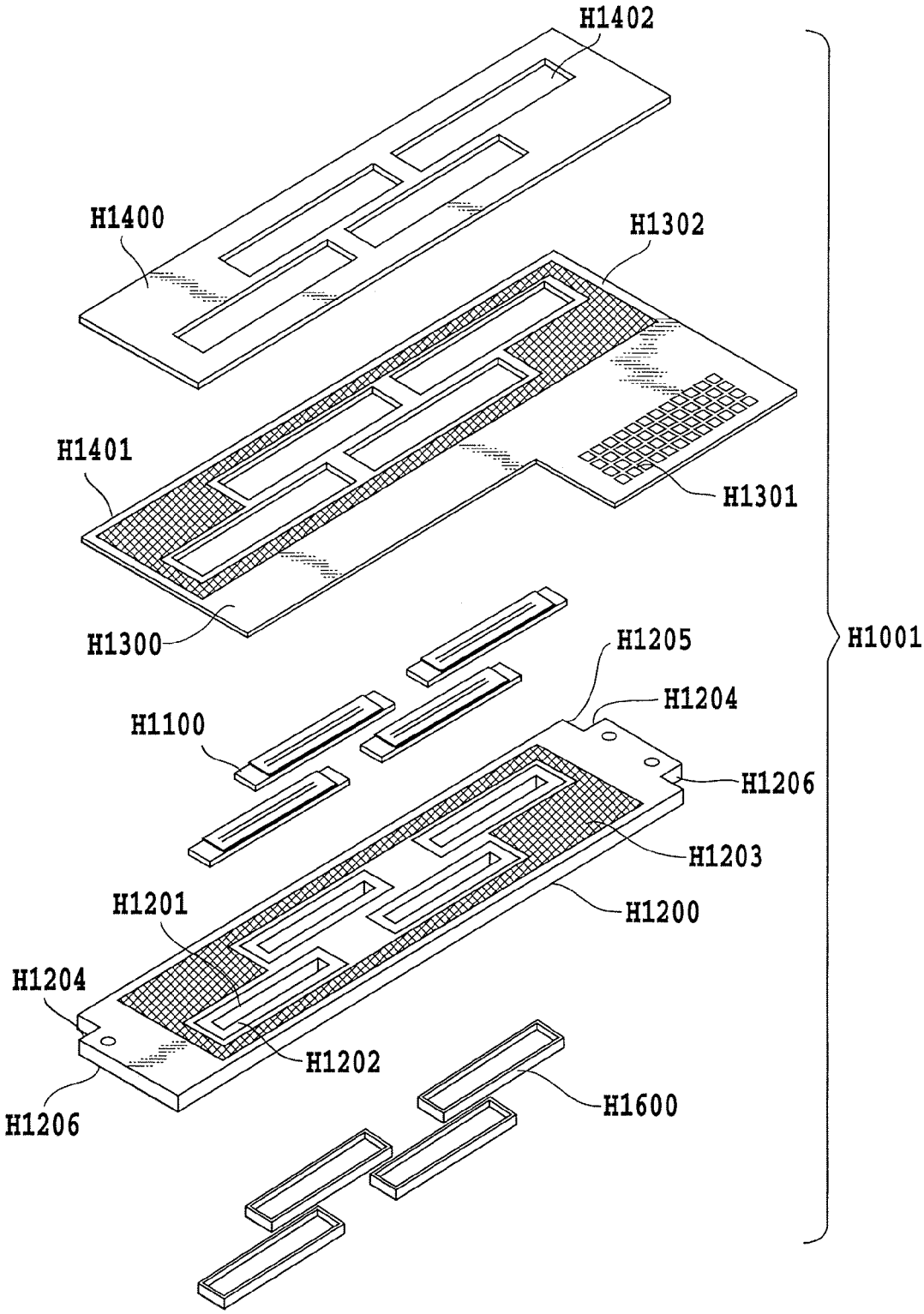
FIG. 7 is an exploded perspective view showing a construction of the nozzle unit.

FIG. 7 is an exploded perspective view showing a construction of the nozzle unit H1001. In the figure, the nozzle unit H1001 is comprised of four nozzle substrates H1100, a first plate H1200, an electric wiring substrate H1300, a second plate H1400, and filter members H1600.

The first plate H1200 is formed of an alumina ($Al_2O_3$) material 0.5-10 mm thick. The material is not limited to alumina but any material may be used if it has a linear expansion coefficient similar to that of the material of the nozzle substrates Hl100 and a thermal conductivity equal to or higher than that of the material of the nozzle substrates H1100. The material of the first plate H1200 may include, for example, silicon (Si), aluminum nitride (AlN), zirconia, silicon nitride ($Si_3N_4$), silicon carbide (SiC), molybdenum (Mo) and tungsten (W). The first plate H1200 is formed with ink supply ports H1201 to supply ink to the nozzle substrates H1100. Ink supply ports H1101 of the nozzle substrates H1100 match the ink supply ports H1201 of the first plate H1200, and the nozzle substrates H1100 are securely bonded to the first plate H1200 with high precision. Therefore, a first bonding agent H1202 preferably has a low viscosity, a thin bonding layer formed over a contact surface and, after hardening, a relative high hardness. It is also desired that the first bonding agent H1202 have an ink resistance. The first bonding agent H1202 may be, for example, a thermosetting bonding agent made mainly of epoxy resin, or an ultraviolet ray hardening and thermosetting bonding agent, preferably having a bonding layer thickness of 50 μm or less. The first plate H1200 has an X-direction reference H1204, a Y-direction reference H1205 and a Z-direction reference H1206.

Four of the nozzle substrates Hl100 are arranged staggered on the first plate H1200 to enable a wide printing of the same color. If, for example, the length of a nozzle column in one nozzle substrate H1100 is 1 inch+a, the four nozzle substrates H1100 enable printing about 4 inches wide.

Referring again to FIG. 5, a nozzle group in a nozzle substrate H1100 and a nozzle group in an adjacent nozzle substrate H1100 overlap each other over a distance (L) in the nozzle column direction at their adjoining ends. This arrangement can prevent a gap from being formed between the printed dots formed by the adjacent nozzle substrates H1100. For instance, a nozzle group H1106*a* and a nozzle group H1106*b* have overlapping areas H1109*a*, H1109*b*.

The electric wiring substrate H1300 applies electric signals to the nozzle substrates H1100 to eject ink. The electric wiring substrate H1300 has openings in which to install the nozzle substrates H1100, and is securely bonded to a main surface of the first plate H1200 with a second bonding agent H1203. Further, the electric wiring substrate H1300 has electrode terminals H1302 corresponding to electrodes H1103 of the nozzle substrates H1100 and an external signal input terminal H1301 situated at a wire end portion to receive electric signals from the printing apparatus body. The electric wiring substrate H1300 and the nozzle substrates H1100 are electrically connected as by gold wires wire-bonded between the electrodes H1103 of the nozzle substrates H1100 and the electrode terminals H1302 of the electric wiring substrate H1300. The electric wiring substrate H1300 may be formed of a flexible wiring substrate which has wires in a two-layer structure with its surface covered with a resist film.

The second plate H1400 is formed of a SUS plate about 0.5-1 mm thick. The material of the second plate is not limited to SUS and any material may be used as long as it has an ink resistance and a good planarity. The second plate H1400 has openings H1402 to accommodate the nozzle substrates H1100 securely bonded to the first plate H1200 and electric mounting regions of the nozzle substrates and the electric wiring substrate H1300. The second plate H1400 is securely bonded to the electric wiring substrate H1300 by a third bonding agent H1401. The second plate H1400 is so constructed that its main surface is at almost the same height as the main surface of the nozzle substrates H110.

Grooves formed by the openings H1402 of the second plate and side surfaces of the nozzle substrates H1100 are filled with a first sealant H1304 to seal the electric mounting portions of the electric wiring substrate H1300, The electrodes H1103 of the nozzle substrates H1100 are sealed with a second sealant H1305 to protect the electric connecting portions against corrosion by ink and external impacts (see FIG. 5).

The ink supply ports H1201 on the back side of the first plate H1200 are securely bonded with filter members H1600 to remove foreign matters that have entered in ink.

Figure 8:
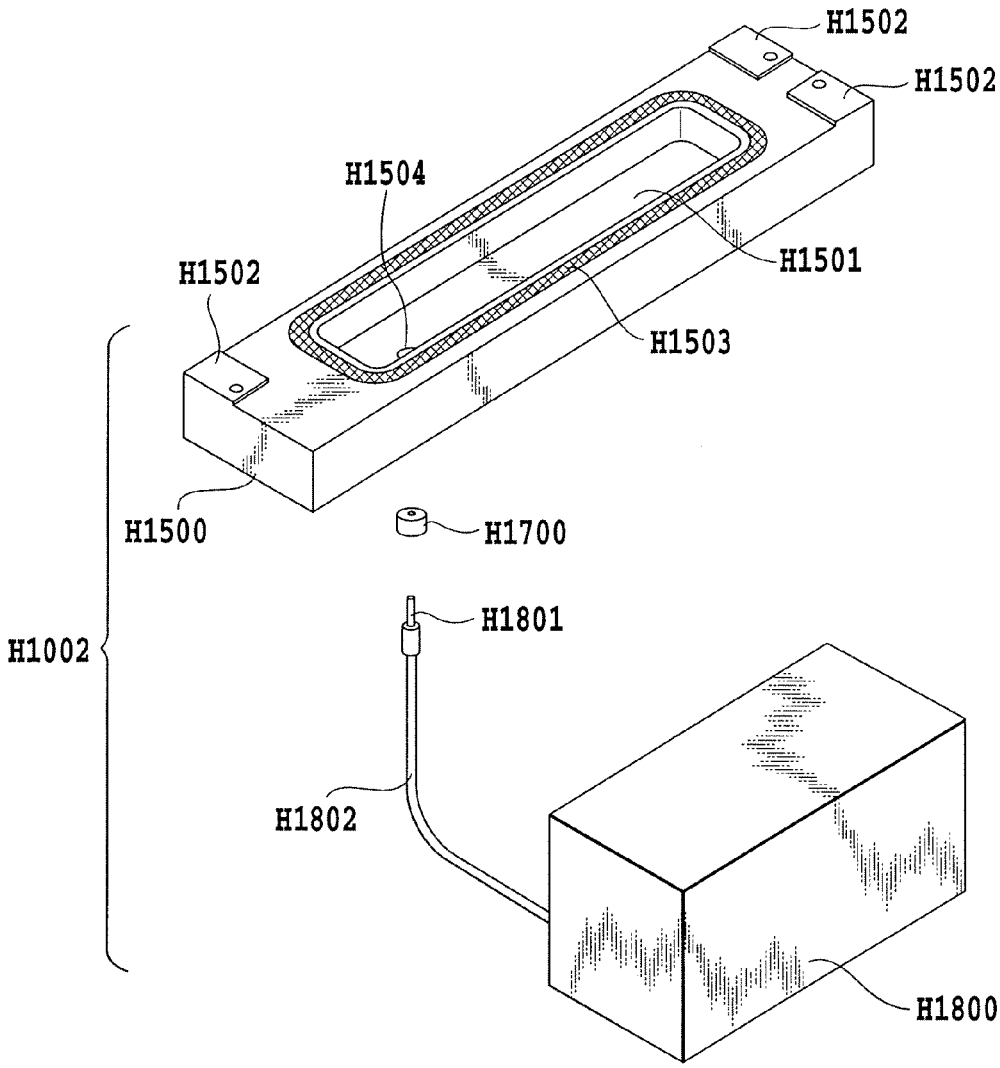
FIG. 8 is an exploded perspective view showing a construction of the ink supply unit.

FIG. 8 is an exploded perspective view showing a construction of the ink supply unit H1002. In the figure, the ink supply unit H1002 comprises mainly an ink supply member H1500 to directly supply ink to the nozzle unit H1001, an ink tank H1800, a tube H1802 connecting the ink supply member H1500 and the ink tank H1800, and a joint rubber H1700 to join the tube H1802 and the ink supply member H1500.

The ink supply member H1500 is formed by resin molding and has a common ink chamber H1501 and a Z reference plane H1502. The Z reference plane H1502 positions the nozzle unit H1001 and serves as a Z reference for the print head H1000.

An ink supply port H1504 to supply ink from the ink tank H1800 is attached with the joint rubber H1700 to prevent an evaporation of ink from the joint portion.

The tube H1802 extending from the ink tank H1800 and the ink supply member H1500 are connected by a needle H1801 provided at the free end of the tube piercing through the joint rubber H1700. The ink used for printing passes through the tube H1802 from the ink tank H1800 and enters into the common ink chamber H1501 of the ink supply member H1500, from which it is supplied through the filter members H1600 to the nozzle unit H1001.

Figure 9A:
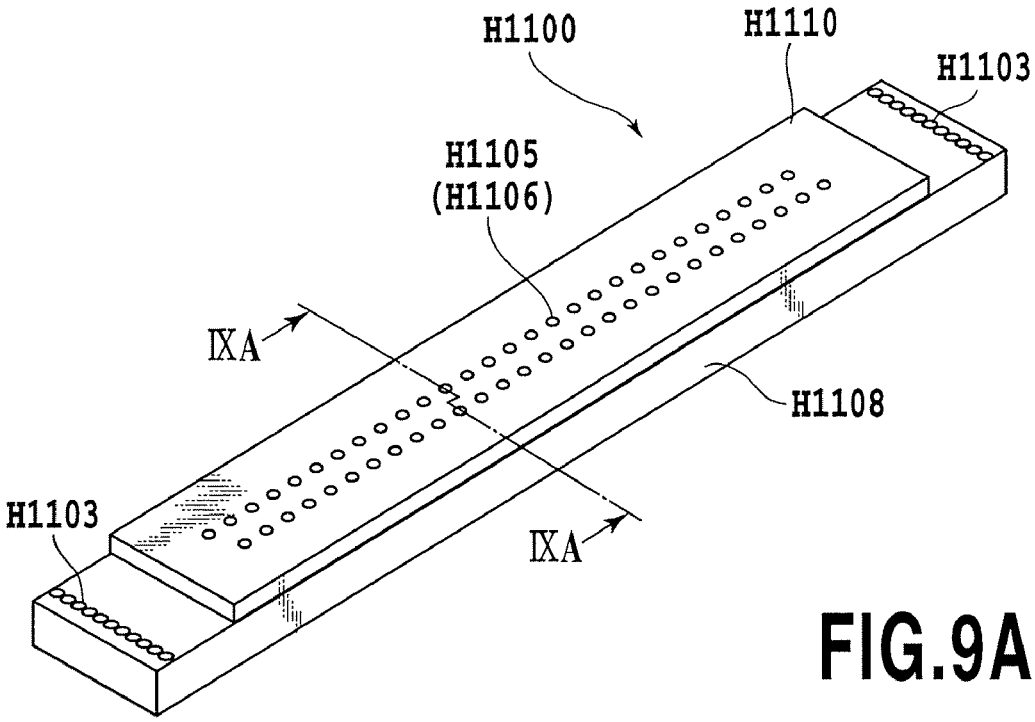
FIGS. 9A and 9B are enlarged and cross-sectional views showing a construction of a nozzle substrate.
Figure 9B:
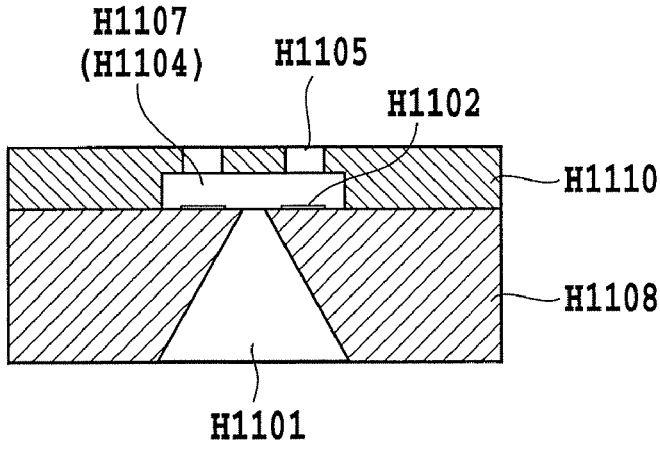

FIGS. 9A and 9B are enlarged views showing a construction of a nozzle substrate H1100. FIG. 9A is an external view of the nozzle substrate H1100 and FIG. 9B a cross-sectional view taken along the line A-A of FIG. 9A. The nozzle substrate H1100 is made up mainly of a silicon substrate H1108 about 0.5-1 mm thick and a nozzle plate H1110.

The silicon substrate H1108 has an ink supply port Hl101 formed in its underside in the form of an elongate piercing slot as part of an ink passage. The ink supply port H1101 can be formed by an anisotropic etching utilizing a crystal orientation of the silicon substrate H1108. For example, if the silicon substrate has a crystal orientation of <100> on the wafer plane and <111> in the thickness direction, the etching progresses at an angle of about 54.7 degrees by the alkaline (KOH, TMAH, hydrazine, etc.) anisotropic etching. Taking advantage of the anisotropic etching, the ink supply port H1101 can be formed to a desired depth.

On each side of an outlet of the ink supply port H110 electrothermal transducers H1102 are arranged in line. The electrothermal transducers H1102 and aluminum wires for supplying electric signals to them are formed on the silicon substrate H1108 by a thin film deposition technique. Further, the electrodes H1103 for supplying electricity to the electric wires are provided on both sides of the nozzle substrate H1100.

The nozzle plate H1110 put on the silicon substrate H1108 has an ink path H1104, nozzle openings H1105 and a bubble chamber H1107 formed therein by the photolithography technique. The ink path H1104 is formed to extend laterally from the outlet position of the ink supply port H1101 up to the electrothermal transducers H1102 according to the position of the electrothermal transducers H1102. The nozzle openings H1105 are provided at positions opposing the corresponding electrothermal transducers H1102. The ink supplied from the ink supply port H1101 is rapidly heated by the electrothermal transducers H1102 to produce a bubble in the ink and is ejected from the nozzle openings H1105 by an expanding force of the bubble.

In this embodiment, each nozzle substrate H1100 has two columns of nozzles—an odd-numbered nozzle column and an even-numbered nozzle column—arranged on both sides of the ink supply port H1101, staggered a half-pitch from each other. Each of the odd- and even-numbered nozzle columns has 640 nozzle openings arrayed at 600 dpi (dots/inch). The nozzle substrate H1100 therefore has a total of 1,280 print elements or nozzles at a density of 1,200 dpi. Further, the print head as a whole drives a total of 5,120 nozzles.

Figure 10:
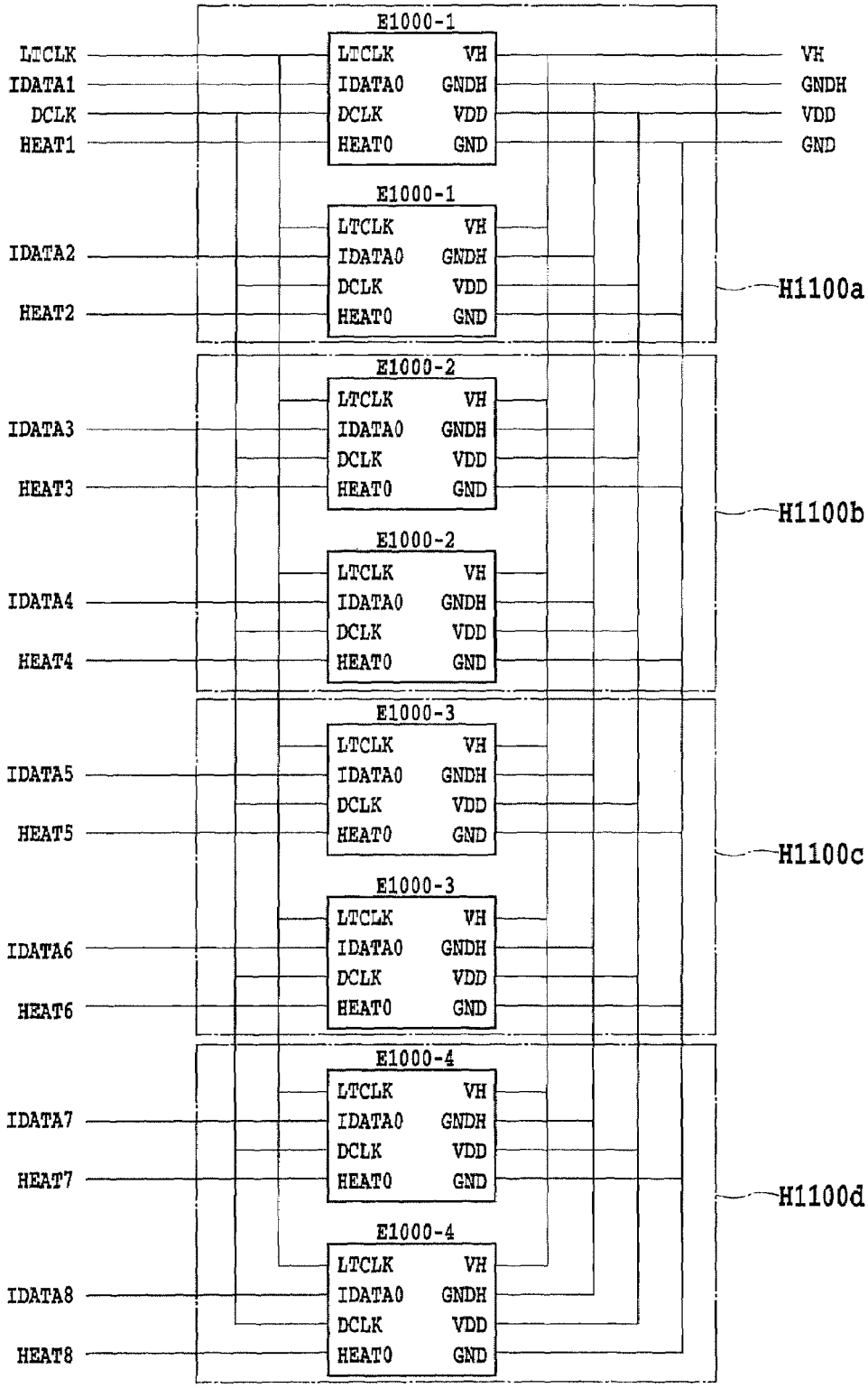
FIG. 10 is a circuit diagram showing electric signal wires of four nozzle substrates.
Figure 11:
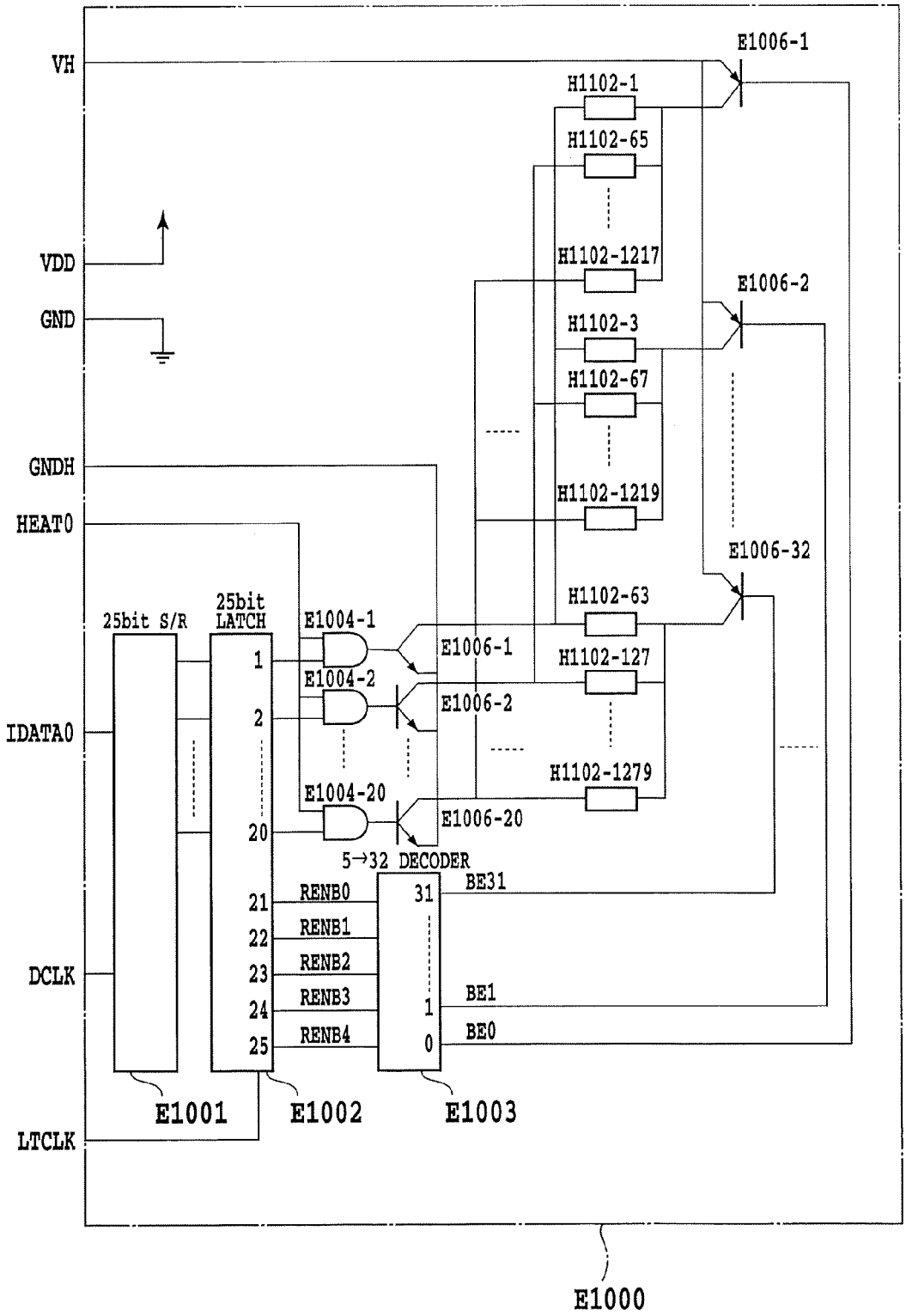
FIG. 11 is a schematic diagram of a drive circuit E1000 for odd-numbered nozzle columns.
Figure 12:
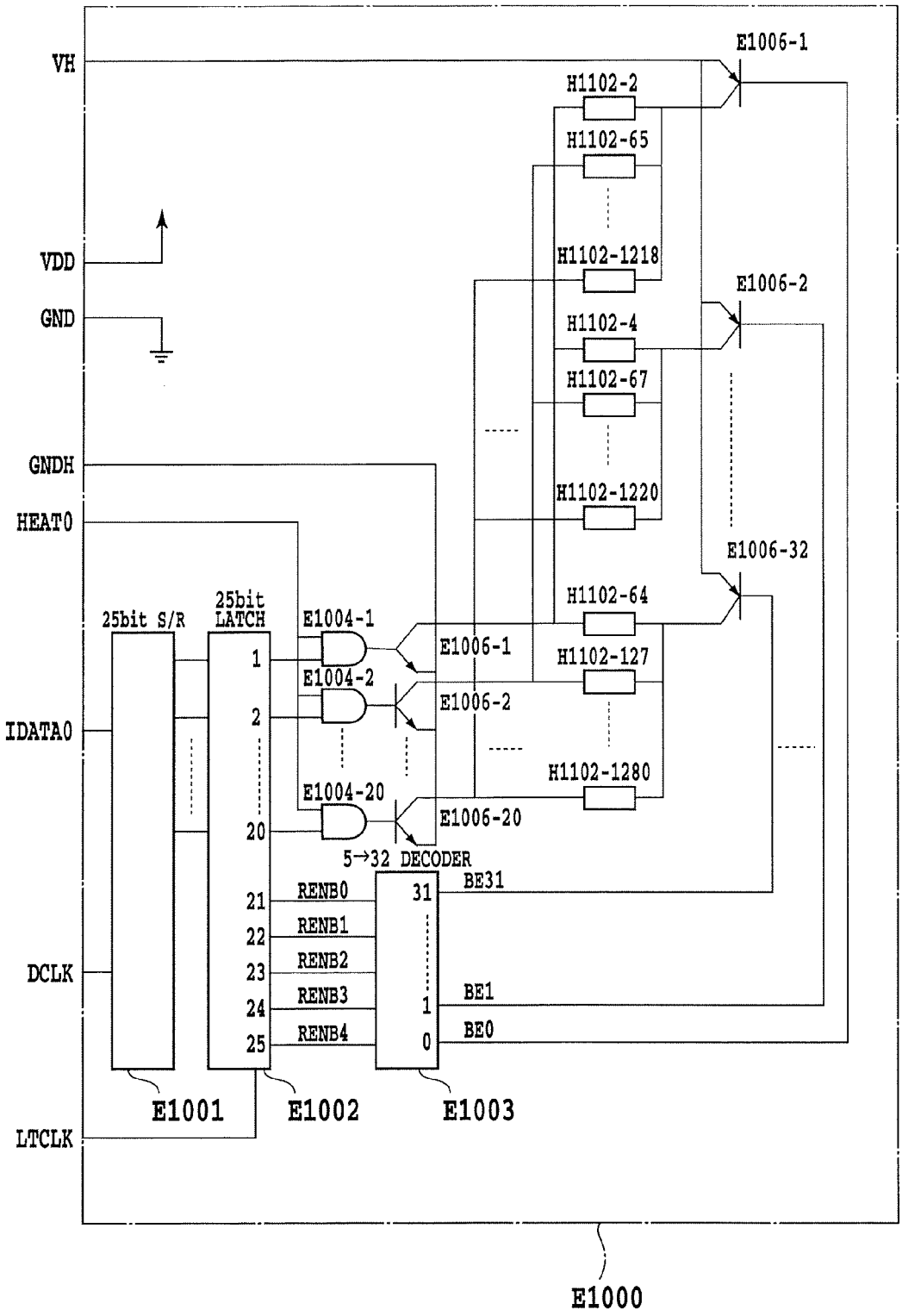
FIG. 12 is a schematic diagram of a drive circuit E1000 for even-numbered nozzle columns.

FIG. 10 is a circuit diagram showing electric signal wires for four nozzle substrates H1100*a*-H1100*d*. As explained with reference to FIG. 9A, each nozzle substrate H1100 has two nozzle columns—odd- and even-numbered nozzle columns—arranged one on each side of the ink supply port H1101. Each of the nozzle substrates H1100*a*-H1100*d* has independent drive circuits, one for the even-numbered nozzle column and one for the odd-numbered nozzle column, as shown in FIG. 11 and FIG. 12. The drive circuits for the two nozzle columns are formed-on each nozzle substrate H1100 by the semiconductor process, with odd- and even-numbered HEAT signals assigned independent drive circuits and also with odd- and even-numbered IDATA signals assigned independent drive circuits. Other signals (DCLK, LTCLK) and power supplies (VDD, GND, VH, HGND) use common wires, respectively. LTCLK, DCLK, HEAT1-8 and IDATA1-8 are connected to the external signal input terminal H1301 and the power supplies VH, GNDH, VDD, GND are connected to the power supply terminal H1302.

FIG. 11 schematically shows a drive circuit E1000 for the odd-numbered nozzle column. The 640 nozzles (or print elements) are provided with electrothermal transducers H1102-1 to H1102-1279 and driving individual electrothermal transducers H1102 causes a bubble to be formed in ink in the associated nozzles and an ink droplet to be ejected. The electrothermal transducers H1102 are divided into 32 drive blocks of 20 transducers each, with the drive blocks driven on a time-division basis. The drive blocks are selected by BE0-31 signals and the energization of each of the 20 electrothermal transducers in one drive block is determined by transistors E1006-1 to E1006-20 being turned on or off.

Figure 13:
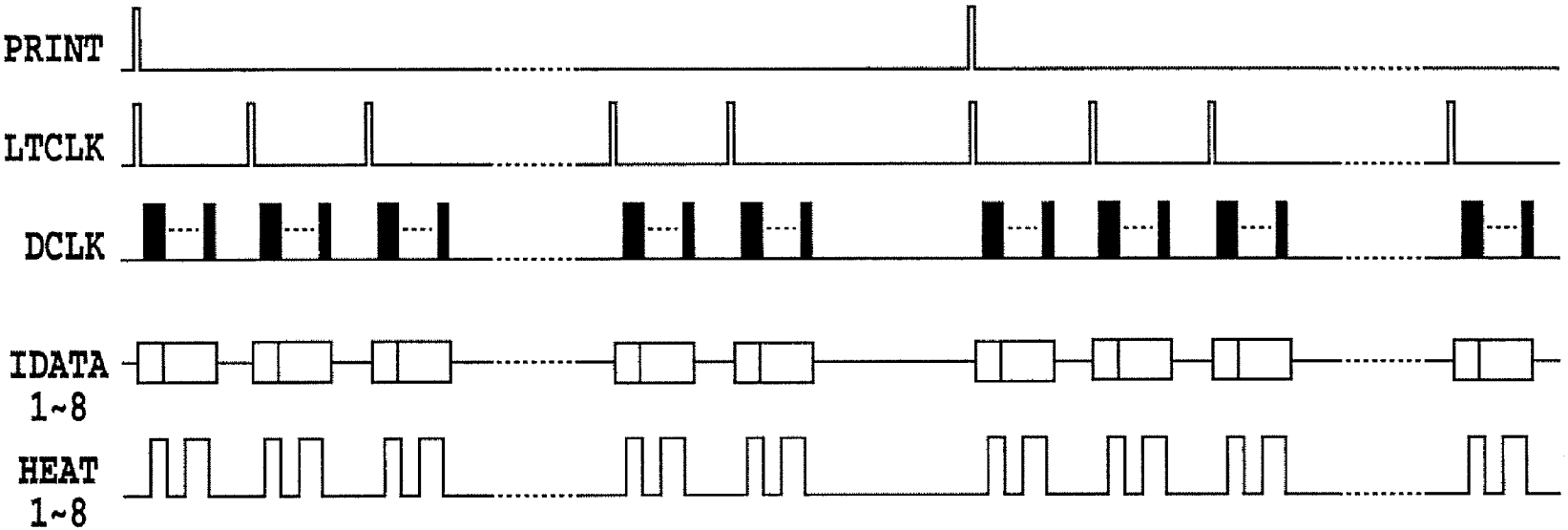
FIG. 13 is a timing chart to drive the print head by the drive circuit.

FIG. 13 is a timing chart showing signals applied to the drive circuit of FIG. 11 to drive the print head H1000. In the diagram, a PRINT signal is a pulse signal to start the ejection of one column. At the leading edge of this pulse, the drive circuit E1000 starts its operation. When the drive circuit starts, it first generates LTCLK and a few 100 ps later a transfer clock DCLK is output for a duration of transfer data, i.e., 25 clocks are output. For each IDATA1-8 signal, transfer data is output in synchronism with DCLK for serial transfer to a 25-bit shift register E1001. Then, the data stored in the shift register E1001 is stored in a 25-bit latch E1002 at a timing of LTCLK that is output at the beginning of the next drive block. Therefore, the timing at which the actual drive is executed according to the first transfer data is when the next block is transferred. The content of data that is transferred here is 5 bits of a block number BENB0-4 to be driven, followed by 20 bits of drive data for the electrothermal transducer H1102 to be driven in that block, i.e., a total of 25 bits. The drive block BENB0-4 is decoded into BE0-31 by a 5-to-32 decoder E1003 and connected to bases of transistors E1005-1 to E1005-32. Of the 32 transistors E1005-1 to E1005-32, only one is driven to apply a drive power (VH) to one end of the electrothermal transducer belonging to the specified block.

At the other end the electrothermal transducers H1102-1 to H1102-1279 are parallelly connected in 20 groups or segments of 32 transducers each, and these 20 segments of the transducers are connected to collectors of 20 transistors E1006-1 to E1006-20. These transistors are controlled by outputs of AND gates E1004-1 to E1004-20 connected to their base. The 20 AND gates have their one input connected with a 20-bit drive data signal and the other input connected with pulse signal HEAT1-8 that gives a trigger for actually driving the electrothermal transducers. Thus, the transistors E1006-1 to E1006-20 are controlled by the above two signals ANDed. As a result, a segment specified by the 20-bit drive data is driven at a pulse timing of HEAT1-8.

As described above, when the PRINT signal is issued, the drive circuit executes its operation, beginning with block 0, followed successively by block 1, block 2, . . . . With the last block 31 driven, the drive operation is completed. In this way all the nozzles of all nozzle substrates are ejection-controlled.

Figure 14:
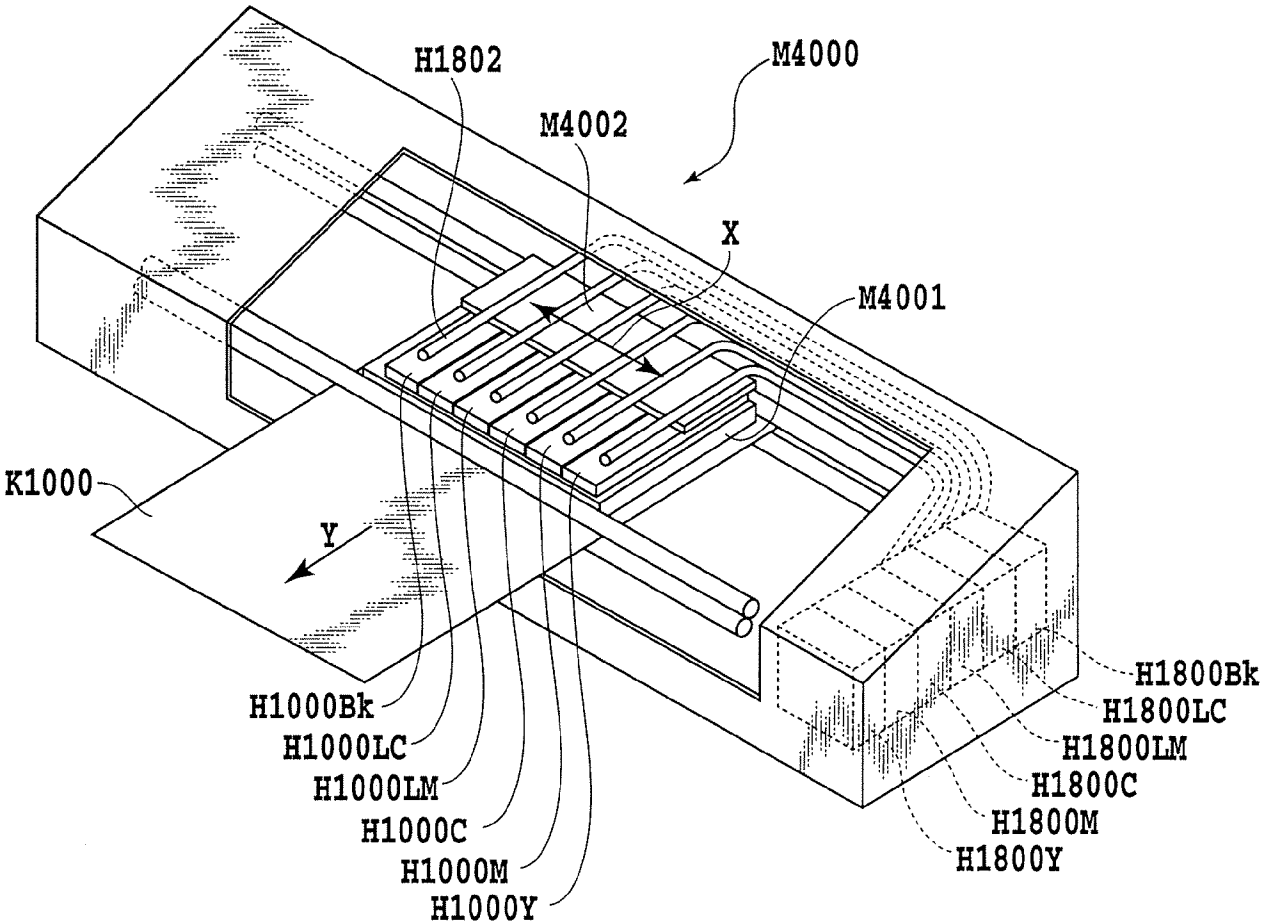
FIG. 14 is a perspective view showing a construction of a serial type ink jet printing apparatus applicable to the embodiments of this invention.

FIG. 14 is a perspective view showing a construction of a serial type ink jet printing apparatus applicable to this embodiment.

The ink jet printing apparatus M4000 of this invention has elongate print head H1000 for six colors to enable picture-quality printing. The print head H1000 is made up of six print heads: H1000Bk for a black ink, H1000C for a cyan ink, H1000M for a magenta ink, H1000Y for a yellow ink, H1000LC for a light cyan ink, and H1000LM for a light magenta ink. These print heads H1000 are securely supported, through a positioning means and an electric contact M4002, on a carriage M4001 mounted on a printing apparatus body M4000.

The carriage M4001 is movable in an X direction in the figure. An image is progressively formed on a print medium K1000 by alternating a main scan and a sub-scan, the main scan involving ejecting ink droplets from the print head H1000 as the carriage M4001 travels in the X direction, the sub-scan involving feeding the print medium K1000 a predetermined distance in the Y direction.

The ink tank H1800 consists of six color ink tanks parallelly and fixedly arranged at the end of the printing apparatus body M4000. To ensure that inks are supplied stably to the print head H1000 while the carriage M4001 is moving, a tube H1802 (actually six tubes) connects the print head H1000 and the ink tank H1800.

Although it can print high-quality images such as photographs when connected with a computer, the printing apparatus body M4000 in this example is mainly used for industrial applications in which fixed patterns are repetitively printed Therefore, a so-called multipass printing is not performed.

Using the ink jet printing apparatus described above, the arrangement and printing method of the nozzle substrates H1100, the most characteristic features of this invention, will be described as follows.

Figure 15:
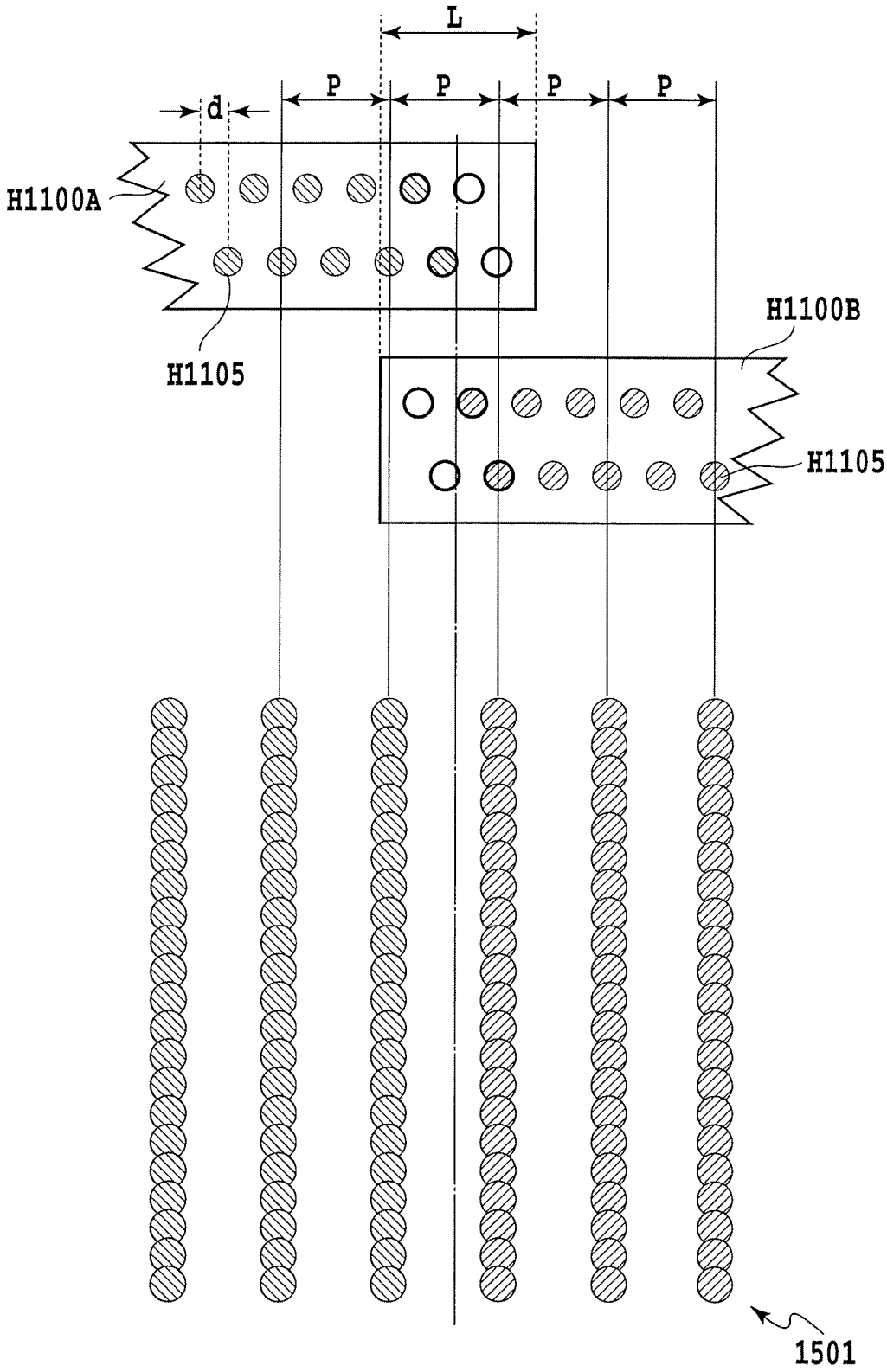
FIG. 15 is a schematic diagram showing an arrangement of nozzle substrates in a first embodiment of this invention and dots formed at a print density of 25%.
Figure 16:
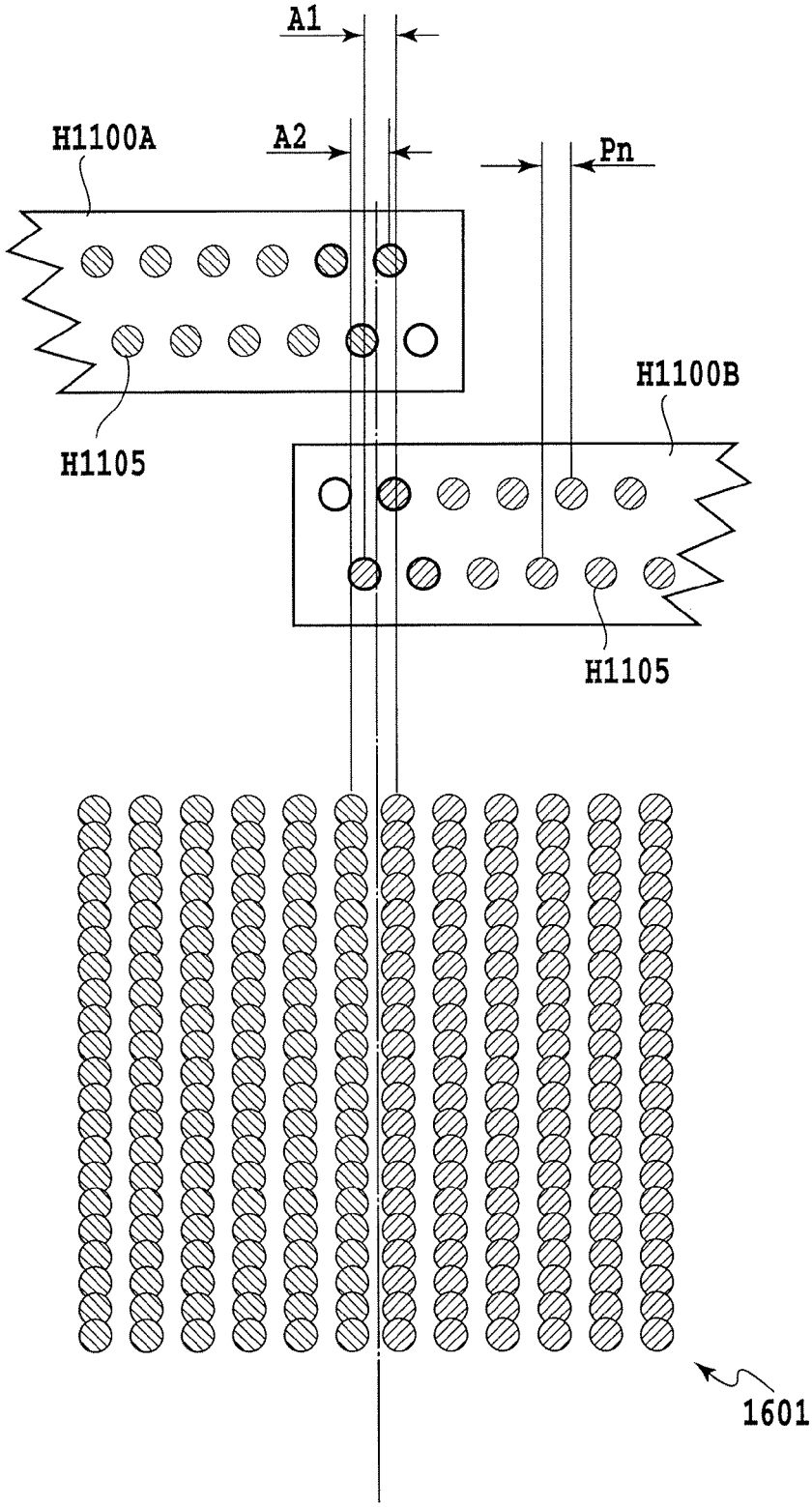
FIG. 16 is a schematic diagram showing an arrangement of nozzle substrates in the first embodiment of this invention and dots formed at a print density of 50%.
Figure 17:
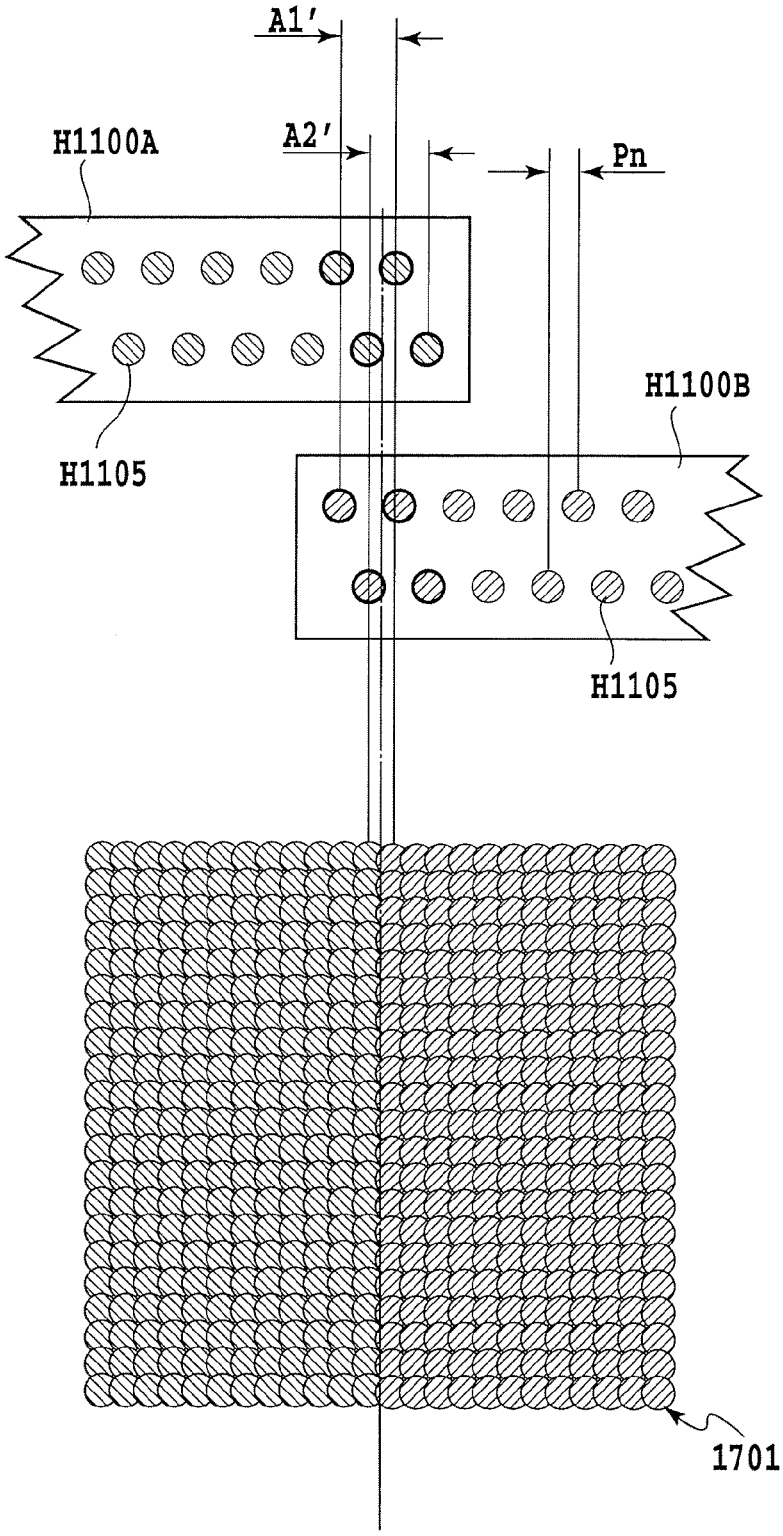
FIG. 17 is a schematic diagram showing an arrangement of nozzle substrates in the first embodiment of this invention and dots formed at a print density of 100%.

FIG. 15, FIG. 16 and FIG. 17 are schematic diagrams showing the arrangement of the nozzle substrates H1100A and H1100B in this embodiment and dots printed at different print densities.

The print density as used in this specification refers to a percentage (%) of the number of actually ejected dots with respect to the maximum number of dots that all the nozzles arrayed in the nozzle substrate can eject per unit of time.

FIG. 15 shows how ink ejection is actually performed when an image is formed at a print density of 25%. As already explained, the print head applied in this embodiment is capable of printing at 1,200 dpi, so the pitch of the nozzles is about 20 μm, which in this figure is represented by a distance d. In this embodiment, as explained with reference to FIG. 5, the two nozzle substrates H1100A and H1100B have an overlapping region which measures L. This overlapping region can be printed with four nozzles of each of the two nozzle substrates Hl100, indicated by thick circles. Hence, in this embodiment, the printing operation in this overlapping region L is divided between the four nozzles of the nozzle substrate H1100A and the four nozzles of the nozzle substrate H1100B, i.e., the printing in this region is done by a total of eight nozzles. While the relation between the nozzle substrates H1100A and H1100B has been described here, the same also applies to the relation between the nozzle substrates H1100B and H1100C and between the nozzle substrates H1100C and H1100D.

When the print density is 25%, an area to the left of a boundary line indicated as a one-dot chain line is printed by only the nozzles of the nozzle substrate H1100A and an area to the right of the boundary line is printed by only the nozzles of the nozzle substrate H1100B. Thus, the nozzles that actually eject ink are those shown shaded with inclined lines and those nozzles indicated by a white circle do not perform ink ejection.

Denoted 1501 is an array of dots formed on a print medium when the printing is done at a print density of 25%. Here, of the nozzles arrayed in the nozzle substrates, every fourth nozzle at intervals of P (P=4d) is used for printing and performs a 100% printing during the main scan operation to realize a print density of 25%. This printing can produce a uniform image with a dot pitch on the print medium matching the nozzle pitch P, as indicated by 1501.

Here, we have shown an example dot array which is formed by using every fourth nozzle and driving them 100% during the main scan operation to realize a print density of 25%. The method of producing an array of dots at the 25% print density is not limited to this method. An array of dots formed at the 25% print density may also be produced by using all the shaded nozzles and activating each of them 25% in the main scan operation. Further, even with a highly diffusive, irregular dot pattern, which is binarized by such means as an error diffusion method, it is possible to realize a 25% print density. No matter on what dot array forming method a dot pattern may be based, if the print density to be realized is 25%, this embodiment employs the above-described method, i.e., uses the shaded nozzles and completely divides the printing duty by the boundary line between the two nozzle substrates H1100A and H1100B. This method can form a uniform image, whatever dot array forming method it is based upon.

FIG. 16 shows how ink ejection is actually performed when an image is formed at a print density of 50%. When the print density is 50%, the nozzle substrate H1100A and the nozzle substrate H1100B additionally use one nozzle each lying beyond the boundary line indicated as a one-dot chain line. In the figure, the nozzles that actually eject ink are shown shaded with inclined lines and are greater in number by one in each nozzle substrate than when the print density is 25% in FIG. 15.

Denoted 1601 is an array of dots. Here, of the nozzles arrayed in the nozzle substrates, every second nozzle is used. They are activated 100% during the main scan operation to realize a print density of 50%.

At a print density of around 50%, the "end dot deflection" phenomenon, such as explained in the Related Art section, more or less occurs. Here, if the same printing as is done for the 25% print density should be performed, an unprinted area is produced at a boundary region. An unprinted area of a large width that exists in only the boundary region can be recognized as a blank or white line.

To deal with this problem, this embodiment causes those nozzles lying beyond the boundary line to also eject ink to fill a blank line at the boundary region with dots in an appropriate state to make the blank line less conspicuous. Ink droplets ejected from those nozzles situated at the rightmost end of the nozzle substrate H1100A which are among the nozzles used to eject ink, land on a print medium deflected toward left in the figure by a distance A2 because of the "end dot deflection" phenomenon. As for the nozzle substrate H1100B, ink droplets ejected from those nozzles situated at the leftmost end of the nozzle substrate which are among the nozzles used to eject ink, land on the print medium deflected toward right in the figure by a distance A1 because of the "end dot deflection" phenomenon. As a result, a uniform image with no white lines can be produced as shown at 1601.

Here we have shown an example array of dots which is formed by using every second nozzle and activating them 100% during the main scan operation to realize a print density of 50%. It is noted, however, that the method of producing an array of dots at the 50% print density is not limited to the array of dots shown at 1601. On whatever dot array forming method a dot pattern may be based, if the print density to be realized is 50%, this embodiment employs the above-described method, i.e., uses the shaded nozzles and also one nozzle each in the nozzle substrates H1100A and H1100B which lies beyond the one-dot chain boundary line. This method can form a uniform image, whatever dot array forming method it is based upon.

FIG. 17 shows how ink ejection is actually performed when an image is formed at a print density of 100%. When the print density is 100%, the nozzle substrate H1100A and the nozzle substrate H1100B additionally use all nozzles (two each) lying beyond the boundary line indicated as a one-dot chain line. In the figure, the nozzles that actually eject ink are shown shaded with inclined lines and are greater in number by two in each nozzle substrate than when the print density is 25% in FIG. 15.

Denoted 1701 is an array of dots formed on a print medium when printing is done at a print density of 100%.

At a print density of close to 100%, the "end dot deflection" phenomenon is more strongly observed. Here, if the same printing as is done for the 25% print density (shown in FIG. 15) should be performed, an even wider unprinted area is produced.

To deal with this problem, this embodiment causes those nozzles in the two nozzle substrates H1100 lying beyond the boundary line to also eject ink to fill a blank line at the boundary region with dots in an appropriate state to make the blank line less conspicuous. Ink droplets ejected from those nozzles situated at the rightmost end of the nozzle substrate H1100A which are among the nozzles used to eject ink, land on a print medium deflected toward left in the figure by a distance A2' because of the "end dot deflection" phenomenon. As for the nozzle substrate H1100B, ink droplets ejected from those nozzles situated at the leftmost end of the nozzle substrate which are among the nozzles used to eject ink, land-on the print medium deflected toward right in the figure by a distance A1' because of the "end dot deflection" phenomenon. As a result, a uniform image with no white lines can be produced as shown at 1701.

As described above, when the print density to be realized is 100%, the nozzle substrates H1100A and H1100B additionally use two nozzles each lying beyond the one-dot chain boundary line when printing an image. With this method, even when a high duty image is printed in one pass, a uniform image with no notable white lines can be produced.

Figure 18:
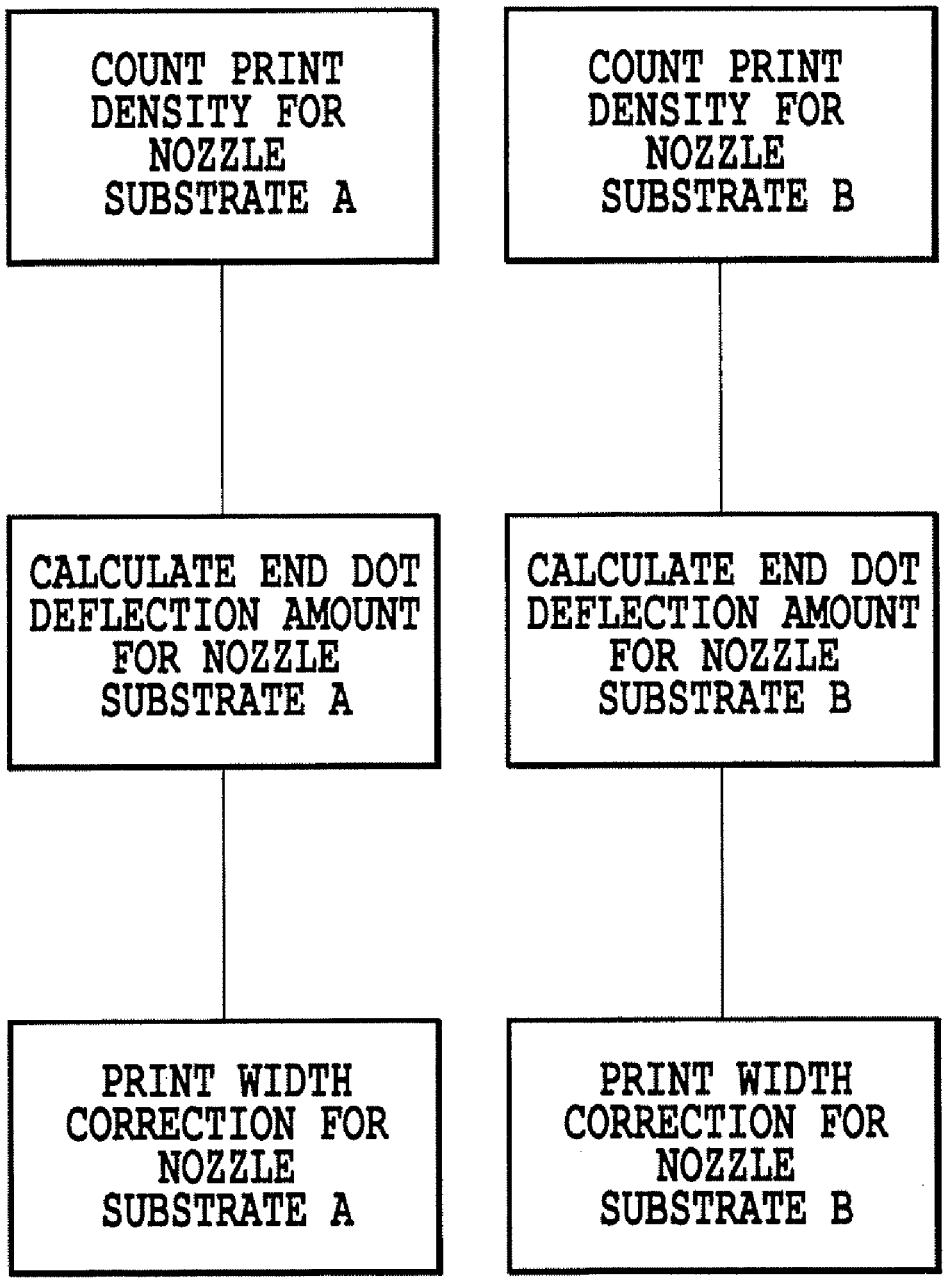
FIG. 18 is a conceptual diagram showing an example method of determining a correction amount that changes according to a print density.

FIG. 18 is a conceptual diagram showing an example method of determining an amount of correction that varies depending on the print density. Here, a print density produced by the print head in a predetermined printing scan is counted for the nozzle substrate H1100A and for the nozzle substrate H1100B independently. Further, a landing position deviation of a dot ejected from a nozzle at the end portion of the nozzle substrate (end dot deflection amount) is calculated for each nozzle substrate H110. Based on the end dot deflection amount obtained, a decision is made on which of the nozzles in the overlapping region is to be actually driven to eject ink.

Figure 19:
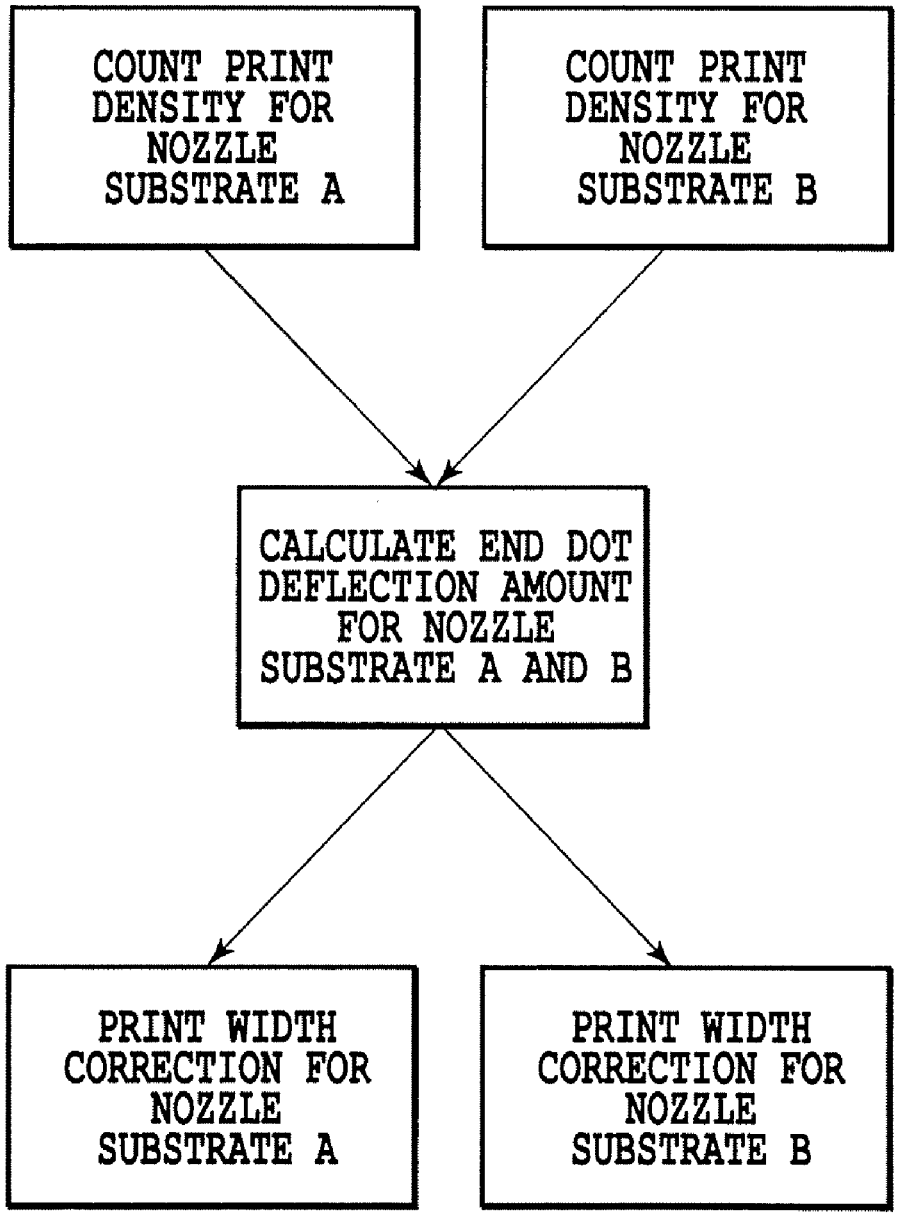
FIG. 19 is a conceptual diagram showing another method of determining a correction amount that changes according to a print density.

FIG. 19 is a conceptual diagram showing another example method, different from that of FIG. 18, for determining an amount of correction. As in FIG. 18, the print density produced by the print head in a predetermined printing scan is counted for the nozzle substrate H1100A and for the nozzle substrate H1100B independently. In calculating the end dot deflection amount, the two values counted independently are used to determine an overall end dot deflection amount at the boundary region. Based on the end dot deflection amount thus obtained, a decision is made as to which of the nozzles in the overlapping region is to be actually driven to eject ink.

FIGS. 18 and 19, as mentioned above, include the step for calculating the end dot deflection amount, which, however, may be skipped in an actual printing operation. According to the steps in FIGS. 18 and 19, a relationship between the print density of the nozzle substrates H1000A, H1000B and the print width of the nozzle substrates H1000A, H1000B are experimentally preliminary obtainable, the print width here corresponding to the number of nozzles to be used for printing of the nozzle substrates H1000A and H1000B. Preliminary grasping of the relationship between the print density and the print width enables direct obtainment of the print width of the nozzle substrates H1000A and H1000B on the basis of the print density of the nozzle substrates H1000A and H1000B dispensing with the end dot deflection amount calculation at the actual printing operation.

Such a printing apparatus may be realized in the process as follows. Experimentation is conducted to obtain the relationship between the print density of the nozzle substrates H1000A, H1000B and the print width of the nozzle substrates H1000A, H1000B, storing a table indicating thus obtained relationship in a memory of the printing apparatus, and working out the print density of the nozzle substrates H1000A and H1000B when the actual printing operation is executed, thereby resulting in deciding the print width of the nozzle substrates H1000A and H1000B based on the aforementioned calculation result and table.

Such construction may contribute to a simplification of data processing since the step for calculating the end dot deflection amount can be skipped.

As described above, this embodiment arranges a plurality of nozzle substrates H1100 so that their printable areas overlap and, according to the print density to be achieved, adjusts the number of those nozzles lying in the overlapping regions of the nozzle substrates which are to be activated to eject ink. This allows an appropriate number of dots to be added to counter the adverse effect of the "end dot deflection" that varies in intensity according to the print density, thereby producing an image with an excellent uniformity.

Second Embodiment

A second embodiment of this invention will be described as follows. The basic construction of the printing apparatus applied in this embodiment is similar to that of the first embodiment explained with reference to FIG. 6 to FIG. 14.

Figure 20:
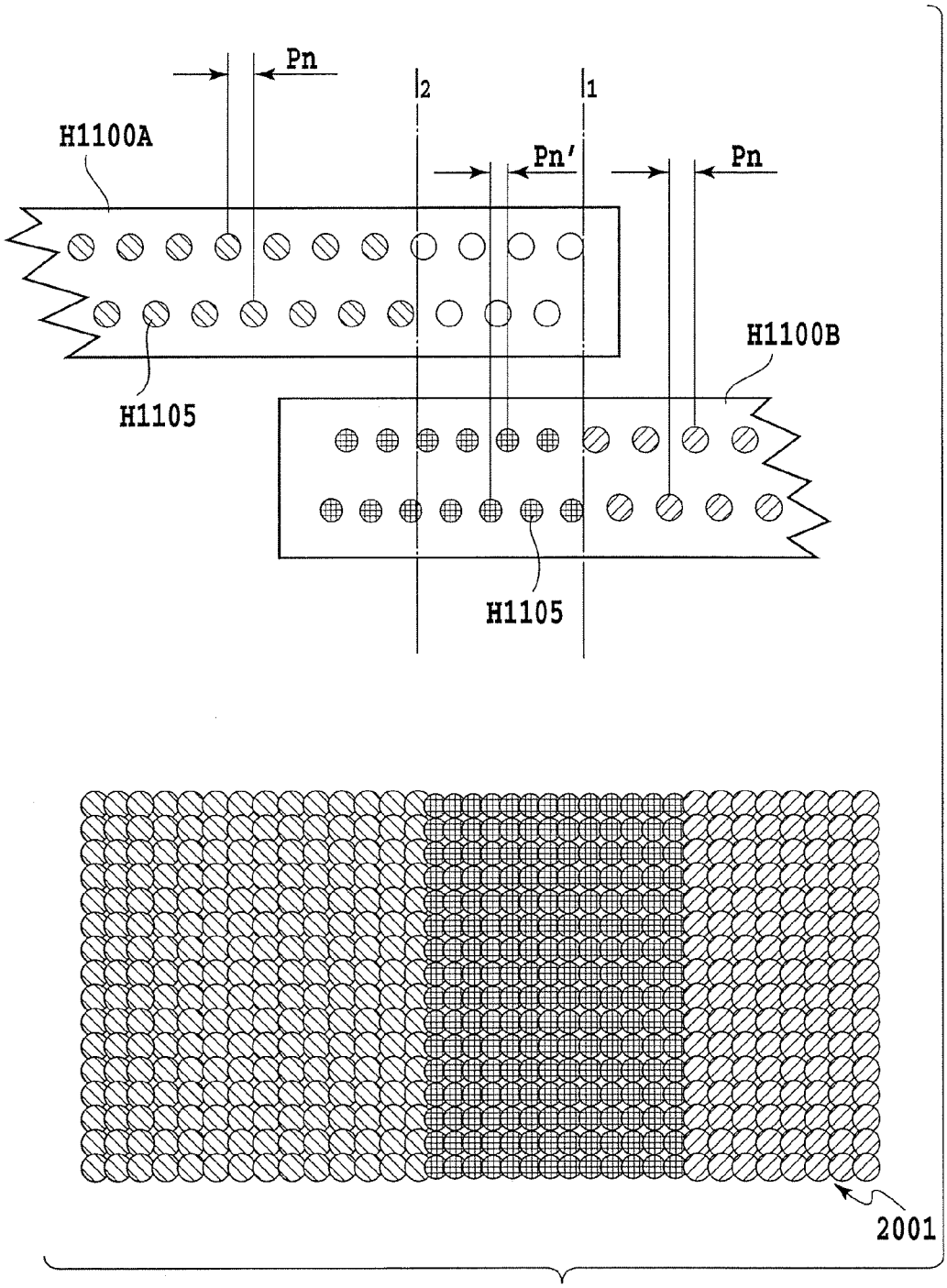
FIG. 20 is a schematic diagram showing an arrangement of nozzle substrates in a second embodiment of this invention and dots formed at a print density of 100%.

FIG. 20 is a schematic diagram showing an arrangement of nozzle substrates H1100A and H1100B in this embodiment and an array of dots to produce a desired print density.

A print head used in this embodiment is capable of printing at 1,200 dpi, so the pitch of the nozzles is about 20 μm, which in this figure is represented by a distance Pn. It is noted that in the overlapping regions of the two nozzle substrates H1100A and HI100B, these nozzle substrates have different pitches of the nozzles H1105. All the nozzles H1105A in the nozzle substrate H1100A and the nozzles H1105B in the nozzle substrate HI100B except the left end portion are arranged at the Pn pitch. Of the nozzles in the nozzle substrate HI100B, those nozzles H1105B lying in the left end portion that overlaps the nozzle substrate H1100A are arranged at a pitch Pn', which is narrower than Pn. As a result, in the overlapping regions of the nozzle substrates H1100A and H1100B, the different pitches of these nozzles are arranged like a vernier scale. In the above construction, the volume of ink ejected from the nozzles arranged at the pitch Pn' is preferably slightly smaller-than that ejected from the nozzles arranged at the pitch Pn.

In this embodiment, when the print density to be realized by the nozzle substrates H1100 is low, the boundary is set at a line 11 indicated as a one-dot chain line In a region to the left of the line 11 printing is done using the nozzle substrate H1100A and, in a region to the right of the line 11, the nozzle substrate H1100B is used.

When the print density to be realized is higher, those nozzles among the 13 nozzles arranged at a pitch Pn' in the overlapping region of the nozzle substrate H1100B which are actually used for printing are progressively increased in number toward the right according to the print density. At this time, the number of those nozzles lying in the overlapping region of the nozzle substrate H1100A which are to be used for printing can be adjusted by taking into account the printable area of the nozzle substrate H1100B so as to produce dots on the print medium in the best pattern possible.

When a printing is done at a print density of 100% as shown at 2001, for example, the printable area of the nozzle substrate H1100A lies to the left of a line 12 and, in the nozzle substrate H1100B, the nozzles up to the leftmost end of the substrate are used for printing. With this arrangement a uniform image with no white lines can be formed on a print medium, as shown at 2001. Since in this embodiment the nozzle pitches in the overlapping regions of the two nozzle substrates are arranged like a vernier, it is possible to choose best combinations of nozzles to fill a blank line formed between the two nozzle substrates with dots, whatever width the blank line may have.

As described above, this embodiment arranges a plurality of nozzle substrates H1100 so that their printable areas overlap and differentiates the nozzle pitches in the overlapping regions between the different nozzle substrates. This arrangement allows white lines caused by the "end dot deflection" phenomenon to be corrected with a more precise volume of ink or more precise number of dots than in the first embodiment.

Third Embodiment

A third embodiment of this invention will be described as follows. The printing apparatus applied in this embodiment is also similar in basic construction to the above embodiment explained with reference to FIG. 6 to FIG. 14.

Figure 21:
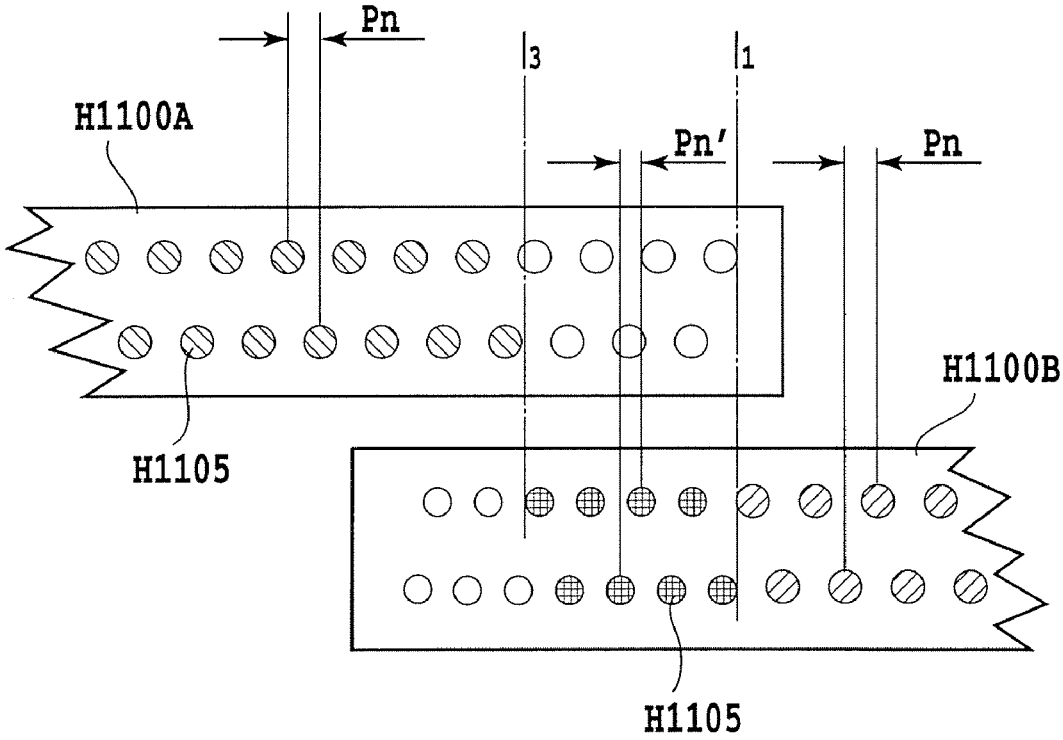
FIG. 21 is a schematic diagram showing an arrangement of nozzle substrates in a third embodiment of this invention.

FIG. 21 is a schematic diagram showing an arrangement of nozzle substrates H1100A and H1100B in this embodiment.

The nozzle substrates H1100A and HI100B applied in this embodiment have the same arrangement of nozzles as that of the second embodiment. Thus a white line at a boundary region can be corrected with high precision as in the second embodiment. This embodiment is characterized in that not only can it produce the above-mentioned effect, but this embodiment can also positively correct a position alignment tolerance of nozzles arrayed in the nozzle substrates H1100. That is, even when the print density is so low that the "end dot deflection" does not occur, the nozzles situated at overlapping regions of the two nozzle substrates are used to correct alignment errors.

For example, in FIG. 21, when the print density is low, what has been described in the above embodiment involves dividing the printable areas of the first nozzle substrate H1100A and the second nozzle substrate H1100B by a boundary line indicated as a one-dot chain line 11. However, in the print head manufacturing process, various factors may cause errors in a positioning precision of a plurality of nozzle substrates that cannot be neglected in terms of image quality. In the arrangement of the nozzle substrates shown in FIG. 21, it is assumed that there are some errors. So, even when the print density is low, the printable area of each nozzle substrate is divided by a line 13 as a boundary. This method can produce dots that present a smoother merge at the boundary between the two nozzle substrates than when the line 11 is used as the boundary line. Since the amount of error varies from one print head to another, the dot alignment should preferably be adjusted for each print head.

Figure 22:
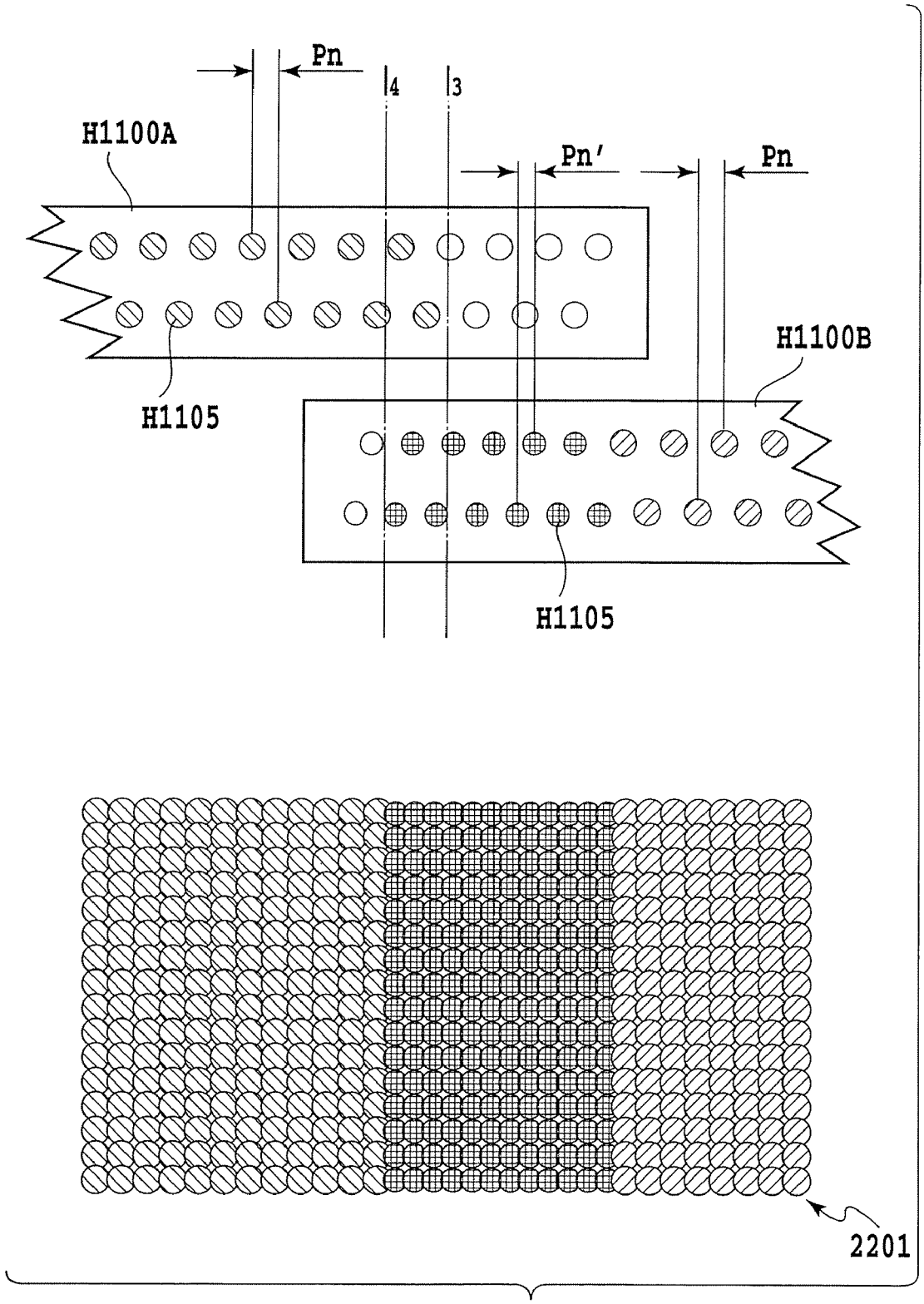
FIG. 22 is a schematic diagram showing an arrangement of nozzle substrates in the third embodiment of this invention and dots formed at a print density of 100%.

FIG. 22 is a schematic diagram showing how ink ejection is actually performed when, in the construction of this embodiment, the print density is higher than that of FIG. 21 and some "end dot deflection" phenomenon is observed. Where the print density is high, an area of those nozzles arrayed in the nozzle substrate H1100B which are used for actual ink ejection is expanded toward left slightly beyond a boundary line 13 to correct the "end dot deflection." At this time, an area of those nozzles in the nozzle substrate H1100A that are used for actual ejection may be retracted by as much as appropriate, as in the second embodiment.

As described above, this embodiment arranges a plurality of nozzle substrates H1100 so that their printable areas overlap and, in their overlapping regions, differentiates the nozzle pitches between the different nozzle substrates, thereby making it possible to smoothly correct merge processing between the nozzle substrates even when there is an alignment error between the nozzle substrates. Further, as in the second embodiment, the third embodiment enables corrections on the "end dot deflection" to be performed with high precision.

Other Embodiments

In the above three embodiments, our explanations have assumed that the printing apparatus is of a serial type. In the serial type printing apparatus, the "end dot phenomenon" occurs not only between different nozzle substrates but also at ends of the print head. To deal with this problem, a paper feed performed between succeeding printing scans may be arranged as follows. The paper feed is controlled to make the printable areas of successive printing scans have a predetermined overlapping region, and at the same time the nozzles at the ends of the print head that correspond to the overlapping region are controlled for their ejection/non-ejection according to the print density. This arrangement can produce almost the same effect as the above embodiments.

Figure 23:
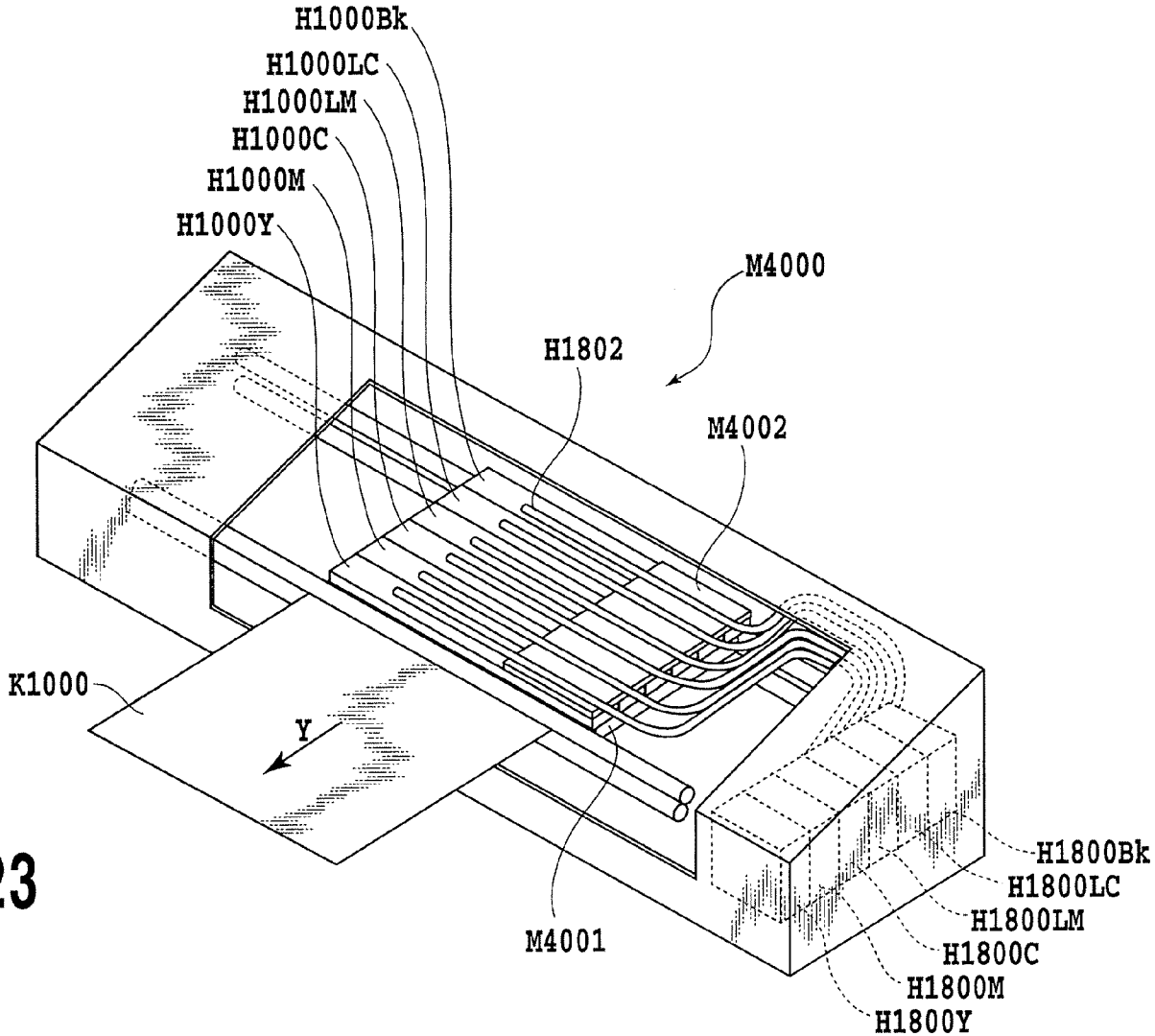
FIG. 23 is a perspective view showing a construction of a line type ink jet printing apparatus applicable to the embodiments of this invention.

It is noted that this invention is not limited to the serial type printing apparatus. FIG. 23 is a perspective view showing a construction of a line type ink jet printing apparatus applicable to this invention for comparison with the serial type of FIG. 14. In the figure, the print head H1000 of six colors is securely supported on the printing apparatus M4000 at a position shown by a positioning means and an electric contact M4002. Individual color print heads eject ink droplets at a predetermined drive frequency according to an input image signal and at the same time a print medium K1000 is intermittently fed at a speed corresponding to the drive frequency to form an image. The ink tanks H1800 are parallelly arrayed and mounted at the right end portion of the printing apparatus body M4000 in the same manner as in FIG. 14 and stably supply inks to the print heads through tubes H1802 that connect the print heads H1000 and the ink tanks H1800.

In such a line type ink jet printing apparatus, since a plurality of nozzle substrates Hl100 are arranged staggered as described above, ink droplets ejected from nozzle substrates situated downstream with respect to a print medium feed direction are likely to be influenced by air flows produced by ink droplets ejected from upstream nozzle substrates. Therefore, a decision on which nozzles are to be activated in each nozzle substrate may be made considering an ejection operation history of the upstream nozzle substrates.

While in the above embodiments, our explanation concerns the number and positions of nozzles actually driven to eject ink for print densities of 25%, 50% and 100%, the relation between the print density and the number of nozzles to be activated in this embodiment is not limited to the example cases described above. A magnitude of the "end dot deflection" and an intensity of the white lines depend on a variety of factors, such as a nozzle density, an ejection volume, ink compositions and the kind of print medium. This invention can be effectively applied if a print head used has an appropriate amount of overlapping region and its correction can be adjusted properly.

Further, in the above embodiments, the print density has been defined as a "percentage (%) of the number of actually ejected dots with respect to the maximum number of dots that all the nozzles arrayed in the nozzle substrate can eject per unit of time." And a method has been described which determines the nozzles to be activated for printing according to a value of the print density. However, the effect of this invention can be produced even if the construction to determine a print density is not provided, as long as a means is employed which provides data serving as a decision reference equivalent to the print density.

For example, the use of a means to count the number of dots that the nozzle substrate prints in a predetermined area makes it possible to grasp the degree of the "end dot deflection." That is, the decision on the nozzles to be activated may be made based on the number of dots to be printed. In that case, the number of dots that the nozzle substrate prints in a predetermined area (=number of data representing a print action) is counted and, according to the count result, the nozzles to be activated are determined. For example, if the count value representing the number of dots to be printed is less than N (N is a positive integer), the selection of nozzles as explained with reference to FIG. 15 is performed. If the count value is equal to N and less than M (M is a positive Integer and M>N), the selection of nozzles as explained in FIG. 16 is performed. If the count value is larger than M, the selection of nozzles as explained in FIG. 17 is done.

Further, the provision of a means to measure an ink volume consumed per unit time in each nozzle substrate also can produce the effect of this invention. This is because, if the ejection volume, the nozzle density and the ejection frequency in the applied print head are set almost constant, the ink volume consumed per unit time in the nozzle substrate is considered to affect the intensity of the "end dot deflection." In other words, if a means is provided that acquires information on the ink volume consumed per unit time in the nozzle substrate, it is possible to grasp the intensity of the "end dot deflection" and perform an appropriate correction. The above-described print density and the number of dots printed in a predetermined area can be said to be among pieces of information related to the ink volume consumed per unit time.

Further, since the above embodiments allow the nozzle density and the drive frequency to be set high and the use of small ink droplets, a print head having an electrothermal transducer in each nozzle has been taken up for explanation. This Invention, however, is not limited to this construction. Even with a print head that employs other constructions to eject ink, if the ejection volume is small and a printing is done at high speed and at high density, there is a possibility that the "end dot deflection" may result. Whatever means is used to eject ink, this invention can work effectively in an ink jet printing apparatus using a print head in a condition that may result in the "end dot deflection."

As described above, with this invention the "end dot deflection" whose intensity varies according to the print density can be corrected using an appropriate number of dots which properly matches the intensity of the end dot deflection. Therefore, blank lines can be filled with an appropriate number of dots at all times no matter how wide the blank lines are, thereby making them less noticeable.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No. 2003-408219 filed Dec. 5, 2003, which is hereby incorporated by reference herein.

What is claimed is:

1. An ink jet printing apparatus for printing an image on a print medium by ejecting inks from nozzles of an ink jet print head with relative movement between the print medium and the ink jet print head, the ink jet print head having a plurality of nozzle substrates each having a plurality of nozzles arrayed therein, the nozzle substrates being arranged so that the respective printable areas of adjacent nozzle substrates partly overlap, the apparatus comprising:

control means for controlling an ejection/non-ejection of ink for each of the nozzles that correspond to an overlapping region in which the respective printable areas of adjacent nozzle substrates partly overlap, according to information related to a printing duty for the nozzles corresponding to the overlapping region and nozzles corresponding to a non-overlapping region other than the overlapping region.

2. An ink jet printing apparatus according to claim 1, wherein the information related to the printing duty is a density of ink ejected by the nozzles corresponding to the overlapping region and the nozzles corresponding to the non-overlapping region.

3. An ink jet printing apparatus according to claim 1, wherein the information related to the printing duty is the number of ink ejections by the nozzles corresponding to the overlapping region and the nozzles corresponding to the non-overlapping region.

4. An ink jet printing apparatus according to claim 1, wherein a pitch of the nozzles corresponding to the overlapping region of one of the adjacent nozzle substrates differs from the pitch of the nozzles corresponding to the overlapping region of another of the adjacent nozzle substrates.

5. An ink jet printing apparatus according to claim 1, wherein the control means controls the ejection/non-ejection of ink for each of the nozzles that correspond to the overlapping region, according to the positional relation among the plurality of nozzle substrates and to the information related to the printing duty.

6. An ink jet printing apparatus according to claim 1, wherein the ink jet printing apparatus forms an image on the print medium by alternating a printing scan and a sub-scan, the printing scan moving the print head as it ejects ink onto the print medium, the sub-scan moving the print medium relative to the print head in a direction crossing the printing scan.

7. An ink jet printing apparatus according to claim 1, wherein the print head is fixedly installed inside the ink jet printing apparatus, and an image is formed on the print medium by ejecting ink from the print head while at the same time moving the print medium relative to the print head in a direction crossing a direction in which the plurality of nozzles are arrayed.

8. An ink jet printing apparatus according to claim 7, wherein the control means controls the ejection/non-ejection of ink for each of the nozzles that correspond to the overlapping region, according to history information related to ink ejections by the nozzle substrates situated upstream more than others in the moving direction of the print medium.

9. An ink jet printing method for printing an image on a print medium moved relative to an ink jet print head, the ink jet print head having a plurality of nozzle substrates each having a plurality of nozzles arrayed therein to eject ink, the nozzle substrates being arranged so that the respective printable areas of adjacent nozzle substrates partly overlap, the ink jet printing method comprising:

a control step of controlling an ejection/non-ejection of ink for each of the nozzles that correspond to an overlapping region in which the respective printable areas of adjacent nozzle substrates partly overlap, according to information related to the printing duty for the nozzles corresponding to the overlapping region and nozzles corresponding to a non-overlapping region other than the overlapping region.

* * * * *

UNITED STATES PATENT AND TRADEMARK OFFICE

CERTIFICATE OF CORRECTION

PATENT NO. : 7,374,265 B2
APPLICATION NO. : 10/998600
DATED : May 20, 2008
INVENTOR(S) : Yamane et al.

It is certified that error appears in the above-identified patent and that said Letters Patent is hereby corrected as shown below:

ON THE TITLE PAGE:

At Item (75), Inventors, "Toru Yamane, Kanagawa (JP); Yasuyuki Tamura, Kanagawa" should read --Toru Yamane, Yokohama (JP); Yasuyuki Tamura, Yokohama (JP)--.

At Item (75), Abstract, Line 5, "arranged" should read --so arranged--.

COLUMN 3:

Line 21, "right." should read --the right.--.

COLUMN 6:

Line 26, "nozzle unit M1001" should read --nozzle unit H1001--.

COLUMN 8:

Line 32, "ink supply part H110" should read --ink supply part H1101--.

COLUMN 9:

Line 5, "formed-on" should read --formed on--.

COLUMN 12:

Line 45, "land-on" should read --land on--.
Line 46, "right" should read --the right--.
Line 64, "nozzle substrate H110." should read --nozzle substrate H1100.--.

COLUMN 13:

Line 19, "preliminary" should read --preliminarily--.

COLUMN 14:

Line 10, "smaller-than" should read --smaller than--.

UNITED STATES PATENT AND TRADEMARK OFFICE

CERTIFICATE OF CORRECTION

PATENT NO. : 7,374,265 B2
APPLICATION NO. : 10/998600
DATED : May 20, 2008
INVENTOR(S) : Yamane et al.

It is certified that error appears in the above-identified patent and that said Letters Patent is hereby corrected as shown below:

COLUMN 16:

Line 54, "Integer" should read --interger--.

Signed and Sealed this

Third Day of March, 2009

JOHN DOLL
*Acting Director of the United States Patent and Trademark Office*